US007949458B2

(12) United States Patent
Yasui et al.

(10) Patent No.: US 7,949,458 B2
(45) Date of Patent: May 24, 2011

(54) CONTROL APPARATUS AND METHOD AND CONTROL UNIT

(75) Inventors: Yuji Yasui, Saitama-ken (JP); Ikue Kawasumi, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 324 days.

(21) Appl. No.: 12/318,741

(22) Filed: Jan. 7, 2009

(65) Prior Publication Data

US 2009/0198430 A1 Aug. 6, 2009

(30) Foreign Application Priority Data

Jan. 8, 2008 (JP) ..... 2008-001078

(51) Int. Cl.
*F02D 45/00* (2006.01)
*F01N 3/10* (2006.01)

(52) U.S. Cl. ..... 701/102; 123/703; 60/285

(58) Field of Classification Search ..... 701/102, 701/103–105, 115; 123/674, 676, 703; 60/274, 60/276, 285
See application file for complete search history.

(56) References Cited

U.S. PATENT DOCUMENTS

| | | | | |
|---|---|---|---|---|
| 6,725,650 | B2 * | 4/2004 | Nishimura | 60/285 |
| 6,976,355 | B2 * | 12/2005 | Imada et al. | 60/285 |
| 2006/0122763 | A1 | 6/2006 | Wang et al. | |
| 2010/0132681 | A1 * | 6/2010 | Okazaki et al. | 123/703 |

FOREIGN PATENT DOCUMENTS

| | | | |
|---|---|---|---|
| EP | 1 010 882 | A2 | 6/2000 |
| EP | 1 757 794 | A1 | 2/2007 |
| EP | 1 916 402 | A1 | 4/2008 |
| JP | 02-059240 | | 4/1990 |
| JP | 06-173743 | A | 6/1994 |
| JP | 7-301140 | A * | 11/1995 |
| JP | 2000-234550 | | 8/2000 |
| JP | 2007-309226 | A | 11/2007 |

OTHER PUBLICATIONS

European Search Report 09000109.0-2311 dated May 14, 2009.
Japanese Office Action application No. 2008-001078 dated Jun. 29, 2010.

* cited by examiner

*Primary Examiner* — Hieu T Vo
(74) *Attorney, Agent, or Firm* — Squire, Sanders & Dempsey (US) LLP

(57) ABSTRACT

A control apparatus capable of ensuring high control accuracy even if a controlled object is in a transient state, when a control input is calculated based on a value obtained by correcting a value calculated by a feedforward control method using a value calculated by a feedback control method. The control apparatus calculates a fuel correction coefficient such that an output from an oxygen concentration sensor converges to a target output, and multiplies a basic injection amount by the coefficient to calculate a fuel injection amount. The basic injection amount is selected from three values according to the cause of a mapping error. Two of them are calculated by searching respective maps according to corrected throttle valve opening values and engine speed. The other is calculated by multiplying a value obtained by searching a map according to the opening and the speed by a correction coefficient.

30 Claims, 20 Drawing Sheets

NOx AMOUNT ON UPSTREAM SIDE
NOx AMOUNT
+
0
NOx AMOUNT ON DOWNSTREAM SIDE

NOx REDUCTION RATE (%)
100
0

VO2
VO2_TRGT
+

DTH1
+
0
-

TH
+
0

NE
+
0
t1
time

NOx AMOUNT ON UPSTREAM SIDE
NOx AMOUNT
+
0
NOx AMOUNT ON DOWNSTREAM SIDE

NOx REDUCTION RATE (%)
100
0

VO2
VO2_TRGT
+

TH
+
0

NE
+
0
t11
t12
time

NOx AMOUNT
NOx AMOUNT ON UPSTREAM SIDE
NOx AMOUNT ON DOWNSTREAM SIDE

NOx REDUCTION RATE (%)
100

VO2
VO2_TRGT

DTH2

θ1

θ2

θ3

TH

NE
t21
time

NOx AMOUNT ON UPSTREAM SIDE
NOx AMOUNT
0
NOx AMOUNT ON DOWNSTREAM SIDE

NOx REDUCTION RATE (%)
100
0

VO2
VO2_TRGT

TH
0

NE
0
t31
t32
time

NOx AMOUNT
NOx AMOUNT ON UPSTREAM SIDE
NOx AMOUNT ON DOWNSTREAM SIDE

NOx REDUCTION RATE (%)
100
0

VO2
VO2_TRGT

Kff
2
1
0

θ1
1
0
-1

θ2
1
0
-1

θ3
1
0
-1

TH
0

NE
0
t41
time

NOx AMOUNT ON UPSTREAM SIDE
NOx AMOUNT
+
0
NOx AMOUNT ON DOWNSTREAM SIDE

NOx REDUCTION RATE (%)
100
0

+
VO2
VO2_TRGT

+
TH
0

+
NE
0
t51
t52
time

CONTROL APPARATUS AND METHOD AND CONTROL UNIT

BACKGROUND OF THE INVENTION

1. Field of the Invention

The present invention relates to a control apparatus and method and a control unit which calculate a control input to a controlled object based on a value obtained by correcting a value calculated by a feedforward control method using a value calculated by a feedback control method.

2. Description of the Related Art

Conventionally, as a control apparatus for controlling the air-fuel ratio of a mixture supplied to an internal combustion engine, the present assignee has already proposed a control apparatus disclosed in Japanese Laid-Open Patent Publication (Kokai) No. 2000-234550. This control apparatus is comprised of a LAF sensor, an oxygen concentration sensor, a state predictor, an onboard identifier, a sliding mode controller, and a target air-fuel ratio-calculating section. The LAF sensor and the oxygen concentration sensor are each for detecting a value indicative of the concentration of oxygen in exhaust gases flowing through an exhaust passage of the engine, that is, an air-fuel ratio, and are inserted into the exhaust passage at respective locations downstream of a collecting section thereof. Further, the engine is provided with a first catalytic device disposed in the exhaust passage at a location downstream of the collecting section, and a second catalytic device disposed on the downstream side of the first catalytic device. The LAF sensor is disposed on the upstream side of the first catalytic device, and the oxygen concentration sensor is disposed between the first catalytic device and the second catalytic device.

This control apparatus employs a discrete-time system model as a controlled object model to which is input the difference DKACT between an actual air-fuel ratio KACT detected by the LAF sensor and an air-fuel ratio reference value FLAFBASE (hereinafter referred to as the "air-fuel ratio difference DKACT") and from which is output the difference DVO2 between an output VOUT of the oxygen concentration sensor and a predetermined target value VOUT_TARGET (hereinafter referred to as the "output difference DVO2"), and calculates a target actual air-fuel KCMD as a control input, as described hereinafter.

More specifically, the state predictor calculates a predicted value of the output difference DVO2 with a predetermined prediction algorithm based on the above-described controlled object model, and the onboard identifier identifies a model parameter of the controlled object model by an sequential least-squares method. Further, the sliding mode controller calculates an operation amount Usl based on the predicted value of the output difference and an identification value of the model parameter with a sliding mode control algorithm such that the output difference DVO2 converges to 0.

Furthermore, the target air-fuel ratio-calculating section calculates a target air-fuel ratio KCMD by adding the operation amount Usl to the air-fuel ratio reference value FLAFBASE, and a feedback correction coefficient-calculating section calculates a feedback correction coefficient KFB such that the air-fuel ratio difference DKACT converges to the target air-fuel ratio KCMD. Further, a basic injection amount-calculating section calculates a basic injection amount Tim by searching a map according to the rotational speed NE of the engine and an intake pressure PB. Furthermore, a demanded fuel injection amount Tcyl is calculated by multiplying the basic injection amount Tim by various correction coefficients.

Then, a fuel injection amount Tout is calculated by multiplying the demanded fuel injection amount Tcyl by the feedback correction coefficient KFB such that the actual air-fuel ratio KACT is caused to converge to the above-described target air-fuel ratio KCMD. As a consequence, the air-fuel ratio is controlled such that the output VOUT from the oxygen concentration sensor converges to the predetermined target value VOUT_TARGET. The predetermined target value VOUT_TARGET is set to such a value as will make it possible to obtain an excellent exhaust emission reduction rate of the catalytic device when the output VOUT from the oxygen concentration sensor takes the target value VOUT_TARGET.

When the above-described control apparatus disclosed in Japanese Laid-Open Patent Publication (Kokai) No. 2000-234550 is attempted to be applied to an engine with small displacement, such as an engine for a motorcycle, it is envisaged to configure the control apparatus, as described below: In general, an engine with small displacement has a characteristic that an intake passage thereof is markedly shorter and a volume of an intake chamber thereof is considerably smaller than those of an engine with large displacement, so that intake pulsation and intake pressure pulsation in the intake passage of the engine with small displacement are larger than those in an intake passage of the engine with large displacement. Therefore, when the basic injection amount Tim is calculated according to the intake air amount or intake pressure, the reliability of a signal from an airflow meter or an intake pressure sensor is so low that the accuracy of the calculation of the basic injection amount Tim is lowered. To solve the problem, it is only required that as a map for use in calculating the basic injection amount Tim, a map associated with the opening TH of a throttle valve (hereinafter referred to as the "throttle valve opening TH"), detected by a throttle valve opening sensor, and the engine speed NE may be used in place of a map used in the control apparatus disclosed in Japanese Laid-Open Patent Publication (Kokai) No. 2000-234550.

Further, if the LAF sensor of the control apparatus disclosed in Japanese Laid-Open Patent Publication (Kokai) No. 2000-234550 is applied to the engine with small displacement, there arises not only the problem of increased costs due to the expensiveness of the LAF sensor, but also the problem of degraded fuel economy due to necessity of heating the LAF sensor by a heater so as to stabilize output therefrom. In view of the problems, it is necessary to omit the LAF sensor. In the case of thus omitting the LAF sensor, it is only required that the control apparatus disclosed in Japanese Laid-Open Patent Publication (Kokai) No. 2000-234550 uses a discrete-time system model as a controlled object model to which is input the difference DKCMD between the target air-fuel ratio KCMD and the air-fuel ratio reference value FLAFBASE, and from which is output the difference DVO2 between the output VOUT of the oxygen concentration sensor and the predetermined target value VOUT_TARGET.

When the control apparatus for the engine with small displacement (hereinafter referred to as the "small-displacement control apparatus") is configured as described above, although it is possible to attain the reduction of costs and the enhancement of fuel economy, when there occur three events: offset displacement, temperature drift, and sludge accumulation, described hereinafter, there is a fear that the basic injection amount Tim cannot be properly calculated. It should be noted that throughout the specification, "offset displacement" is intended to mean that the zero point position of the throttle valve sensor is displaced from a correct position thereof due to impact or mechanical play. Further, "temperature drift" is intended to mean that during high-load operation of the engine in a high temperature state, a signal from the throttle valve opening sensor drifts, whereby the throttle valve opening TH calculated based on the signal deviates from an actual value. Furthermore, "sludge accumulation" is intended to mean a state in which sludge is accumulated on the throttle valve and an inner wall of the intake passage around the throttle vale due to long-term use of the engine.

When the above-described offset displacement or temperature drift is caused, the relationship between an appropriate value (necessary value) of the basic injection amount Tim and the throttle valve opening TH deviates from the relationship between a map value and the throttle valve opening TH. It should be noted that in the following description of the specification, an error of the basic injection amount Tim calculated from a map with respect to the appropriate value is referred to as a "mapping error". When such a mapping error us caused, in the above-described small-displacement control apparatus, air-fuel ratio feedback control is performed using the feedback correction coefficient KFB, so that when the engine is in a steady operating condition, it is possible to cause the output VOUT from the oxygen concentration sensor to converge to the predetermined target value VOUT_TARGET while compensating for the influence of the mapping error.

However, the feedback control method has a characteristic that it has lower responsiveness than that of the feedforward control method, and hence in the case of occurrence of the above-described mapping error, if the engine shifts from the steady operating condition to transient operating conditions, the influence of the mapping error cannot be properly compensated for, whereby the output VOUT from the oxygen concentration sensor deviates from the predetermined target value VOUT_TARGET. This results in the degraded accuracy of the air-fuel ratio control, causing increased exhaust emissions.

Further, when the sludge accumulation is caused, the intake air amount becomes lower than when the sludge accumulation is not caused, so that the relationship between the appropriate value of the basic injection amount Tim and the throttle valve opening TH and the engine speed NE deviates from the relationship between a map value and the throttle valve opening TH and the engine speed NE, causing a mapping error. As a consequence, as described above, when the engine is in transient operating conditions, the influence of the mapping error cannot be properly compensated for, which degrades the accuracy of the air-fuel ratio control, resulting in increased exhaust emissions.

SUMMARY OF THE INVENTION

It is an object of the present invention to provide a control apparatus and method and a control unit which are capable of ensuring high control accuracy even if a controlled object is in a transient state, when a control input is calculated based on a value which is obtained by correcting a value calculated by a feedforward control method using a value calculated by a feedback control method.

To attain the above object, in a first aspect of the present invention, there is provided a control apparatus for controlling a controlled variable of a controlled object by a control input, comprising controlled variable-detecting means for detecting the controlled variable, target controlled variable-setting means for setting a target controlled variable serving as a target to which the controlled variable is controlled, feedback correction value-calculating means for calculating a feedback correction value for performing feedback control of the controlled variable such that the controlled variable is caused to converge to the target controlled variable, with a predetermined feedback control algorithm, first operational state parameter-detecting means for detecting a first operational state parameter indicative of an operational state of the controlled object, except for the controlled variable, feedforward input-calculating means for calculating a feedforward input for feedforward-controlling the controlled variable to the target controlled variable, using a correlation model representative of a correlation between the feedforward input and the first operational state parameter, and the first operational state parameter, and control input-calculating means for calculating the control input based on a value obtained by correcting the feedforward input using the feedback correction value, wherein the feedforward input-calculating means calculates a modification value for making the feedback correction value equal to a predetermined target value with a predetermined control algorithm, modifies one of the first operational state parameter and the correlation model using the modification value, and calculates the feedforward input using the modified one of the first operational state parameter and the correlation model and the other thereof.

With the configuration of this control apparatus, the feedback correction value for performing feedback control of the controlled variable such that the controlled variable is caused to converge to the target controlled variable is calculated with the predetermined feedback control algorithm, and the feedforward input for feedforward-controlling the controlled variable to the target controlled variable is calculated using the correlation model representative of the correlation between the feedforward input and the first operational state parameter, and the first operational state parameter. The control input is calculated based on the value obtained by correcting the feedforward input using the feedback correction value. When the control input is calculated as described above, if the correlation model does not properly represent an actual correlation between the feedforward input and the first operational state parameter, due to the degraded reliability of detection results of the first operational state parameter and aging of the control apparatus, in other words, if the correlation model deviates from the actual correlation between the two, the feedforward input is calculated as an improper value, so that the controlled variable deviates from the target controlled variable to cause a control error. In the case of occurrence of the control error, if the controlled object is in a steady state, the control error can be properly compensated for by the feedback correction value, whereas if the controlled object is in a transient state, it is impossible to properly compensate for the control error using the feedback correction value since the feedback control method has the characteristic that it has lower responsiveness than that of the feedforward control method. Further, the degree of the magnitude of the feedback correction value calculated in such a transient state represents the degree of the magnitude of the control error.

In contrast, according to the control apparatus, the modification value for making the feedback correction value equal to the predetermined target value is calculated with the predetermined control algorithm, and one of the first operational state parameter and the correlation model is modified using the modification value. That is, one of the correlation model and the first operational state parameter is modified such that the feedback correction value becomes equal to the predetermined target value. Further, the feedforward input is calculated using the modified one and the other of the correlation model and the first operational state parameter, and hence even when the correlation model deviates from the actual correlation between the correlation model and the first operational state parameter, causing deviation of the feedback correction value from the predetermined target value, the feedforward input can be calculated such that feedback correction value becomes equal to the predetermined target value. In short, it is possible to accurately calculate the feedforward input while quickly and properly compensating for the deviation of the correlation model. As a consequence, even when the controlled object is in a transient state, the control error can be properly controlled, thereby making it possible to ensure high control accuracy. Particularly, if an N-dimensional map (N is a natural number) representing the correlation between the first operational state parameter and the feedforward input, which is generally used in the feedforward control method, a calculating equation representing the correlation therebetween, or the like is used as the correlation model, the control error can be more quickly compensated for than in a case where the same is compensated for by the feedback correction value. (It should be noted that throughout the specification, "correlation model" is not limited to a response surface model or a mathematical model but includes all models which represent the correlation between the first operational state parameter and the feedforward input, such as the N-dimensional map (N is a natural number) and a predetermined calculation algorithm. Further, "detection of a parameter" in the present specification is not limited to direct detection of the parameter by a sensor, but includes calculation or estimation thereof).

Preferably, the feedforward input-calculating means comprises modified operational state parameter-calculating means for calculating a modified operational state parameter by modifying the first operational state parameter using the modification value, and input-calculating means for calculating the feedforward input using the modified operational state parameter and the correlation model.

With the configuration of the preferred embodiment, the modified operational state parameter is calculated by modifying the first operational state parameter using the modification value, and the feedforward input is calculated using the modified operational state parameter and the correlation model. Therefore, even if the controlled object is in a transient state in the case of occurrence of deviation of the correlation model from the actual correlation between the feedforward input and the first operational state parameter, it is possible to accurately calculate the feedforward input while quickly and properly compensating for the deviation of the correlation model.

More preferably, the feedforward input-calculating means further comprises first sensitivity parameter-calculating means for calculating a first sensitivity parameter indicative of a sensitivity of the feedforward input to the first operational state parameter according to the first operational state parameter, first modified difference-calculating means for calculating a first modified difference by modifying a difference between the feedback correction value and the predetermined target value using the first sensitivity parameter, and first modification value-calculating means for calculating the modification value with the predetermined control algorithm such that the first modified difference becomes equal to 0.

With the configuration of the preferred embodiment, the first sensitivity parameter indicative of the sensitivity of the feedforward input to the first operational state parameter is calculated according to the first operational state parameter, and the first modified difference is calculated by modifying the difference between the feedback correction value and the predetermined target value using the first sensitivity parameter. The modification value is calculated with the predetermined control algorithm such that the first modified difference becomes equal to 0. That is, the modification value is calculated such that the feedback correction value becomes closer to the predetermined target value, while causing the sensitivity of the feedforward input to the first operational state parameter to be reflected on the modification value. Therefore, even in a controlled object in which the sensitivity of the feedforward input to the first operational state parameter largely changes depending on the region of the first operational state parameter, it is possible to properly calculate the feedforward input while preventing the feedforward input from performing an oscillating behavior or being erroneously modified by the modification value. This makes it possible to enhance the control accuracy.

More preferably, the control apparatus further comprises second operational state parameter-detecting means for detecting a second operational state parameter indicative of an operational state of the controlled object, except for the controlled variable, and the feedforward input-calculating means comprises second modification value-calculating means for calculating a plurality of first products by multiplying a difference between the feedback correction value and the predetermined target value by values of a plurality of respective predetermined first functions, calculating a plurality of first modification coefficients with the predetermined control algorithm such that the plurality of first products become equal to 0, calculating a plurality of second products by multiplying the plurality of first modification coefficients by the values of the plurality of respective predetermined first functions, respectively, and calculating the modification value using a total sum of the plurality of second products, wherein the plurality of predetermined first functions are associated with a plurality of regions formed by dividing a region within which the second operational state parameter is variable, respectively, and are set to values other than 0 in the associated regions and to 0 in regions other than the associated regions, each two adjacent regions overlapping each other, the plurality of predetermined first functions being set such that an absolute value of a total sum of respective values of ones of the first functions associated with the overlapping regions becomes equal to an absolute value of a maximum value of the first functions.

With the configuration of the preferred embodiment, the plurality of predetermined first functions are associated with the plurality of regions formed by dividing the region within which the second operational state parameter is variable, respectively, and are set to values other than 0 in the associated regions and to 0 in the regions other than the associated regions. The plurality of predetermined first functions are set such that in the regions overlapping each other, the absolute value of the total sum of respective values of ones of the first functions associated with the overlapping regions becomes equal to the absolute value of the maximum value of the first functions. The plurality of first products are calculated by multiplying the difference between the feedback correction value and the predetermined target value by the plurality of predetermined first functions set as above, and the plurality of first modification coefficients are calculated with the predetermined control algorithm such that the plurality of first products become equal to 0. This makes it possible to distribute the difference to the plurality of first modification coefficients via the values of the plurality of first functions, thereby making it possible to properly compensate for the degree of deviation of the correlation model in each of the plurality of regions. Particularly in the case of occurrence of the deviation of the correlation model, even if the direction of change in the deviation is different between regions, the deviation can be compensated for on a region-by-region basis.

Further, since the plurality of second products are calculated by multiplying the plurality of first modification coefficients by the values of the plurality of respective predetermined first functions, the total sum of the plurality of second products can be calculated as a value obtained by continuously coupling the first modification coefficients. Therefore, by calculating the modification value using the thus calculated total sum of the plurality of second products, even when the second operational state parameter suddenly changes, it is possible to calculate the feedforward input such that the feedforward input changes smoothly and steplessly. This makes it possible to improve the accuracy and stability of control.

Further preferably, the second modification value-calculating means comprises second sensitivity parameter-calculating means for calculating a second sensitivity parameter indicative of a sensitivity of the feedforward input to the first operational state parameter according to the first operational state parameter, first modified product-calculating means for calculating a plurality of first modified products by modifying the plurality of first products using the second sensitivity parameter, and first modification coefficient-calculating means for calculating a plurality of first modification coefficients with the predetermined control algorithm such that the plurality of first modified products become equal to 0.

With the configuration of the preferred embodiment, the second sensitivity parameter indicative of the sensitivity of the feedforward input to the first operational state parameter is calculated according to the first operational state parameter, and the plurality of first modified products are calculated by modifying the plurality of first products using the second sensitivity parameter. The plurality of first modification coefficients are calculated with the predetermined control algorithm such that the plurality of first modified products become equal to 0. That is, the first modification coefficients are calculated such that the plurality of first modified products become equal to 0, while causing the sensitivity of the feedforward input to the first operational state parameter to be reflected on the first modification coefficients, and the modification value is calculated using the thus calculated first modification coefficients. Therefore, even in a controlled object in which the sensitivity of the feedforward input to the first operational state parameter largely changes depending on the region of the first operational state parameter, it is possible to properly calculate the feedforward input while preventing the feedforward input from performing an oscillating behavior or being erroneously modified by the modification value. This makes it possible to further enhance the control accuracy.

Preferably, the feedforward input-calculating means comprises model value-calculating means for calculating a model value of the feedforward input using the first operational state parameter and the correlation model, and input-setting means for setting a product of the model value and the modification value as the feedforward input.

With the configuration of the preferred embodiment, the model value of the feedforward input is calculated using the first operational state parameter and the correlation model, and the product of the model value and the modification value is set as the feedforward input. Consequently, the feedforward input is calculated by modifying the correlation model by the modification value. Therefore, even if the controlled object is in a transient state in the case of occurrence of deviation of the correlation model from the actual correlation between the feedforward input and the first operational state parameter, it is possible to accurately calculate the feedforward input while quickly and properly compensating for the deviation of the correlation model.

More preferably, the control apparatus further comprises third operational state parameter-detecting means for detecting a third operational state parameter indicative of an operational state of the controlled object, except for the controlled variable, and the feedforward input-calculating means comprises third modification value-calculating means for calculating a plurality of third products by multiplying a difference between the feedback correction value and the predetermined target value by values of a plurality of respective predetermined second functions, calculating a plurality of second modification coefficients with the predetermined control algorithm such that the plurality of third products become equal to 0, calculating a plurality of fourth products by multiplying the plurality of second modification coefficients by the values of the plurality of respective predetermined second functions, respectively, and calculating the modification value using a sum of a total sum of the plurality of fourth products and a predetermined value, wherein the plurality of predetermined second functions are associated with a plurality of regions formed by dividing a region within which the third operational state parameter is variable, respectively, and are set to values other than 0 in the associated regions and to 0 in regions other than the associated regions, each two adjacent regions overlapping each other, the plurality of predetermined second functions being set such that an absolute value of a total sum of respective values of ones of the second functions associated with the overlapping regions becomes equal to an absolute value of a maximum value of the second functions.

With the configuration of the preferred embodiment, the plurality of predetermined second functions are associated with the plurality of regions formed by dividing the region within which the third operational state parameter is variable, respectively, and are set to values other than 0 in the associated regions and to 0 in the regions other than the associated regions. The plurality of predetermined second functions are set such that in regions overlapping each other, the absolute value of the total sum of the respective values of ones of the second functions associated with the overlapping regions becomes equal to the absolute value of the maximum value of the second functions. The plurality of third products are calculated by multiplying the difference between the feedback correction value and the predetermined target value by the values of the plurality of predetermined second functions set as above, and the plurality of second modification coefficients are calculated with the predetermined control algorithm such that the plurality of third products become equal to 0. This makes it possible to distribute the difference to the plurality of second modification coefficients via the values of the plurality of second functions, thereby making it possible to properly compensate for the degree of deviation of the correlation model in each of the plurality of regions. Particularly, in the case of occurrence of deviation of the correlation mode, even if the direction of change in the deviation is different between regions, the deviation can be compensated for on a region-by-region basis.

Further, since the plurality of fourth products are calculated by multiplying the plurality of second modification coefficients by the values of the plurality of predetermined second functions, respectively, it is possible to calculate the total sum of the plurality of fourth products as a value obtained by continuously coupling the second modification coefficients. Therefore, by calculating the modification value using the sum of the thus calculated total sum of the plurality of fourth products and the predetermined value, even when the third operational state parameter suddenly changes, it is possible to calculate the feedforward input such that the feedforward input changes smoothly and steplessly. This makes it possible to improve the accuracy and stability of control.

Further preferably, the first operational state parameter is formed by a plurality of operational state parameters indicative of operational states of the controlled object, and the third modification value-calculating means sets the sum of the total sum of the plurality of fourth products and a predetermined value to the modification value.

In the case of this control apparatus, when a model representative of the correlation between the plurality of operational state parameters and the feedforward input is used as the correlation model, the deviation of the correlation model is in a non-linear relation with respect to a combination of the plurality of operational state parameters. In contrast, with the configuration of the preferred embodiment, the feedforward input is calculated by multiplying a model value calculated based on the correlation model by the sum of the total sum of the plurality of fourth products and the predetermined value, and therefore even in the case of occurrence of the above-described non-linear deviation, it is possible to compensate for the deviation quickly and properly, thereby making it possible to further improve the control accuracy.

Further preferably, the third modification value-calculating means comprises third sensitivity parameter-calculating means for calculating a third sensitivity parameter indicative of a sensitivity of the feedforward input to the first operational state parameter according to the first operational state parameter, third modified product-calculating means for calculating a plurality of third modified products by modifying the respective plurality of third products using the third sensitivity parameter, and second modification coefficient-calculating means for calculating the plurality of second modification coefficients with the predetermined control algorithm such that the plurality of third modified products become equal to 0.

With the configuration of the preferred embodiment, the third sensitivity parameter indicative of the sensitivity of the feedforward input to the first operational state parameter is calculated according to the first operational state parameter, and a third modified difference is calculated by modifying the difference between the feedback correction value and the predetermined target value using the third sensitivity parameter. Further, each second modification coefficient is calculated with the predetermined control algorithm such that the third modified difference becomes equal to 0. That is, the second modification coefficient is calculated such that the feedback correction value becomes closer to the predetermined target value, while causing the sensitivity of the feedforward input to the first operational state parameter to be reflected on the second modification coefficient, and the modification value is calculated using the second modification coefficient. Therefore, even in a controlled object in which the sensitivity of the feedforward input to the first operational state parameter largely changes depending on the region of the first operational state parameter, it is possible to properly calculate the feedforward input while preventing the feedforward input from performing an oscillating behavior or being erroneously modified by the modification value. This makes it possible to further enhance the control accuracy.

Preferably, the controlled variable is an output from an exhaust gas concentration sensor for detecting a concentration of a predetermined component of exhaust gases in an exhaust passage of an internal combustion engine at a location downstream of a catalytic device, and the target controlled variable is a target output at which an exhaust emission reduction rate of the catalytic device is estimated to be placed in a predetermined state, the controlled variable being an amount of fuel to be supplied to the engine, the first operational state parameter being an operating condition parameter indicative of an operating condition of the engine, the feedforward input being a basic value of the amount of fuel to be supplied to the engine, and the feedback correction value being a fuel correction coefficient which is calculated with the predetermined feedback control algorithm such that the output from the exhaust gas concentration sensor converges to the target output, and by which the basic value of the amount of fuel to be supplied to the engine is multiplied.

In the case of this control apparatus, the fuel correction coefficient is calculated with the predetermined feedback control algorithm such that the output from the exhaust gas concentration sensor converges to the target output, and the basic value of the amount of fuel to be supplied to the engine is calculated using the correlation model representative of the correlation between the basic value and the operational state parameter, and the operational state parameter. Further, the amount of fuel to be supplied to the engine is calculated by multiplying the basic value of the amount of fuel to be supplied to the engine, by the fuel correction coefficient. If the amount of fuel to be supplied to the engine is calculated as described above, when the correlation model does not properly represent an actual correlation between the basic value of the amount of fuel to be supplied to the engine and the operational state parameter, due to the degraded reliability of detection results of the operational state parameter or the aging of the control apparatus, in other words, when the correlation model deviates from the above-described actual correlation between the basic value of the amount of fuel and the operational state parameter, the basic value of the amount of fuel to be supplied to the engine is calculated as an improper value, whereby the output from the exhaust gas concentration sensor deviates from the target output to increase the difference between the output from the exhaust gas concentration sensor and the target output. This can cause the exhaust emission reduction rate of the catalytic device to deviate from the predetermined state. In this case, if the engine is in a steady state, the difference can be properly compensated for by the feedback correction value, whereas when the engine is in a transient state, since the feedback control method has the characteristic that it has lower responsiveness than that of the feedforward control method, it is impossible to properly compensate for the difference using the feedback correction value.

In contrast, with the configuration of the preferred embodiment, the modification value for making the fuel correction coefficient equal to the predetermined target value is calculated with the predetermined control algorithm, and one of the operational state parameter and the correlation model is modified by the modification value. More specifically, one of the correlation model and the operational state parameter and is modified such that the fuel correction coefficient becomes equal to the predetermined target value. Further, the basic value of the amount of fuel to be supplied to the engine is calculated using the modified one and the other of the correlation model and the operational state parameter, and hence even when the correlation model deviates from the actual correlation between the two, by is properly setting the predetermined target value, it is possible to accurately calculate the basic value of the amount of fuel to be supplied to the engine while quickly and properly compensating for the deviation. As a consequence, even if the engine is in a transient state, it is possible to suppress the difference between the output from the exhaust gas concentration sensor and the target output to a very small value, thereby making it possible to maintain the exhaust emission reduction rate of the catalytic device at the predetermined state. Therefore, by setting the predetermined state to the excellent exhaust emission reduction rate of the catalytic device, it is possible to ensure excellently reduced exhaust emissions.

To attain the above object, in a second aspect of the present invention, there is provided a method of controlling a controlled variable of a controlled object by a control input, comprising a controlled variable-detecting step of detecting the controlled variable, a target controlled variable-setting step of setting a target controlled variable serving as a target to which the controlled variable is controlled, a feedback correction value-calculating step of calculating a feedback correction value for performing feedback control of the controlled variable such that the controlled variable is caused to converge to the target controlled variable, with a predetermined feedback control algorithm, a first operational state parameter-detecting step of detecting a first operational state parameter indicative of an operational state of the controlled object, except for the controlled variable, a feedforward input-calculating step of calculating a feedforward input for feedforward-controlling the controlled variable to the target controlled variable, using a correlation model representative of a correlation between the feedforward input and the first operational state parameter, and the first operational state parameter, and a control input-calculating step of calculating the control input based on a value obtained by correcting the feedforward input using the feedback correction value, wherein the feedforward input-calculating step includes calculating a modification value for making the feedback correction value equal to a predetermined target value with a predetermined control algorithm, modifying one of the first operational state parameter and the correlation model using the modification value, and calculating the feedforward input using the modified one of the first operational state parameter and the correlation model and the other thereof.

With the configuration of the method according to the second aspect of the present invention, it is possible to obtain the same advantageous effects as provided by the first aspect of the present invention.

Preferably, the feedforward input-calculating step comprises a modified operational state parameter-calculating step of calculating a modified operational state parameter by modifying the first operational state parameter using the modification value, and a input-calculating step of calculating the feedforward input using the modified operational state parameter and the correlation model.

More preferably, the feedforward input-calculating step further comprises a first sensitivity parameter-calculating step of calculating a first sensitivity parameter indicative of a sensitivity of the feedforward input to the first operational state parameter according to the first operational state parameter, a first modified difference-calculating step of calculating a first modified difference by modifying a difference between the feedback correction value and the predetermined target value using the first sensitivity parameter, and a first modification value-calculating step of calculating the modification value with the predetermined control algorithm such that the first modified difference becomes equal to 0.

More preferably, the method further comprises a second operational state parameter-detecting step of detecting a second operational state parameter indicative of an operational state of the controlled object, except for the controlled variable, wherein the feedforward input-calculating step comprises a second modification value-calculating step of calculating a plurality of first products by multiplying a difference between the feedback correction value and the predetermined target value by values of a plurality of respective predetermined first functions, calculating a plurality of first modification coefficients with the predetermined control algorithm such that the plurality of first products become equal to 0, calculating a plurality of second products by multiplying the plurality of first modification coefficients by the values of the plurality of respective predetermined first functions, respectively, and calculating the modification value using a total sum of the plurality of second products, and the plurality of predetermined first functions are associated with a plurality of regions formed by dividing a region within which the second operational state parameter is variable, respectively, and are set to values other than 0 in the associated regions and to 0 in regions other than the associated regions, each two adjacent regions overlapping each other, the plurality of predetermined first functions being set such that an absolute value of a total sum of respective values of ones of the first functions associated with the overlapping regions becomes equal to an absolute value of a maximum value of the first functions.

Further preferably, the second modification value-calculating step comprises a second sensitivity parameter-calculating step of calculating a second sensitivity parameter indicative of a sensitivity of the feedforward input to the first operational state parameter according to the first operational state parameter, a first modified product-calculating step of calculating a plurality of first modified products by modifying the plurality of first products using the second sensitivity parameter, and a first modification coefficient-calculating step of calculating a plurality of first modification coefficients with the predetermined control algorithm such that the plurality of first modified products become equal to 0.

Preferably, the feedforward input-calculating step comprises a model value-calculating step of calculating a model value of the feedforward input using the first operational state parameter and the correlation model, and an input-setting step of setting a product of the model value and the modification value as the feedforward input.

More preferably, the method further comprises a third operational state parameter-detecting step of detecting a third operational state parameter indicative of an operational state of the controlled object, except for the controlled variable, wherein the feedforward input-calculating step comprises a third modification value-calculating step of calculating a plurality of third products by multiplying a difference between the feedback correction value and the predetermined target value by values of a plurality of respective predetermined second functions, calculating a plurality of second modification coefficients with the predetermined control algorithm such that the plurality of third products become equal to 0, calculating a plurality of fourth products by multiplying the plurality of second modification coefficients by the values of the plurality of respective predetermined second functions, respectively, and calculating the modification value using a sum of a total sum of the plurality of fourth products and a predetermined value, and the plurality of predetermined second functions are associated with a plurality of regions formed by dividing a region within which the third operational state parameter is variable, respectively, and are set to values other than 0 in the associated regions and to 0 in regions other than the associated regions, each two adjacent regions overlapping each other, the plurality of predetermined second functions being set such that an absolute value of a total sum of respective values of ones of the second functions associated with the overlapping regions becomes equal to an absolute value of a maximum value of the second functions.

Further preferably, the first operational state parameter is formed by a plurality of operational state parameters indicative of operational states of the controlled object, and the third modification value-calculating step includes setting the sum of the total sum of the plurality of fourth products and a predetermined value to the modification value.

Further preferably, the third modification value-calculating step comprises a third sensitivity parameter-calculating step of calculating a third sensitivity parameter indicative of a sensitivity of the feedforward input to the first operational state parameter according to the first operational state parameter, a third modified product-calculating step of calculating a plurality of third modified products by modifying the respective plurality of third products using the third sensitivity parameter, and a second modification coefficient-calculating step of calculating the plurality of second modification coefficients with the predetermined control algorithm such that the plurality of third modified products become equal to 0.

Preferably, the controlled variable is an output from an exhaust gas concentration sensor for detecting a concentration of a predetermined component of exhaust gases in an exhaust passage of an internal combustion engine at a location downstream of a catalytic device, the target controlled variable being a target output at which an exhaust emission reduction rate of the catalytic device is estimated to be placed in a predetermined state, the controlled variable being an amount of fuel to be supplied to the engine, the first operational state parameter being an operating condition parameter indicative of an operating condition of the engine, the feedforward input being a basic value of the amount of fuel to be supplied to the engine, and the feedback correction value being a fuel correction coefficient which is calculated with the predetermined feedback control algorithm such that the output from the exhaust gas concentration sensor converges to the target output, and by which the basic value of the amount of fuel to be supplied to the engine is multiplied.

With the configurations of these preferred embodiments, it is possible to obtain the same advantageous effects as provided by the respective corresponding preferred embodiments of the first aspect of the present invention.

To attain the above object, in a third aspect of the present invention, there is provided a control unit including a control program for causing a computer to execute a method of controlling a controlled variable of a controlled object by a control input, wherein the method comprises a controlled variable-detecting step of detecting the controlled variable, a target controlled variable-setting step of setting a target controlled variable serving as a target to which the controlled variable is controlled, a feedback correction value-calculating step of calculating a feedback correction value for performing feedback control of the controlled variable such that the controlled variable is caused to converge to the target controlled variable, with a predetermined feedback control algorithm, a first operational state parameter-detecting step of detecting a first operational state parameter indicative of an operational state of the controlled object, except for the controlled variable, a feedforward input-calculating step of calculating a feedforward input for feedforward-controlling the controlled variable to the target controlled variable, using a correlation model representative of a correlation between the feedforward input and the first operational state parameter, and the first operational state parameter, and a control input-calculating step of calculating the control input based on a value obtained by correcting the feedforward input using the feedback correction value, wherein the feedforward input-calculating step includes calculating a modification value for making the feedback correction value equal to a predetermined target value with a predetermined control algorithm, modifying one of the first operational state parameter and the correlation model using the modification value, and calculating the feedforward input using the modified one of the first operational state parameter and the correlation model and the other thereof.

With the configuration of the control unit according to the third aspect of the present invention, it is possible to obtain the same advantageous effects as provided by the first aspect of the present invention.

Preferably, the feedforward input-calculating step comprises a modified operational state parameter-calculating step of calculating a modified operational state parameter by modifying the first operational state parameter using the modification value, and a input-calculating step of calculating the feedforward input using the modified operational state parameter and the correlation model.

More preferably, the feedforward input-calculating step further comprises a first sensitivity parameter-calculating step of calculating a first sensitivity parameter indicative of a sensitivity of the feedforward input to the first operational state parameter according to the first operational state parameter, a first modified difference-calculating step of calculating a first modified difference by modifying a difference between the feedback correction value and the predetermined target value using the first sensitivity parameter, and a first modification value-calculating step of calculating the modification value with the predetermined control algorithm such that the first modified difference becomes equal to 0.

More preferably, the method further comprises a second operational state parameter-detecting step of detecting a second operational state parameter indicative of an operational state of the controlled object, except for the controlled variable, wherein the feedforward input-calculating step comprises a second modification value-calculating step of calculating a plurality of first products by multiplying a difference between the feedback correction value and the predetermined target value by values of a plurality of respective predetermined first functions, calculating a plurality of first modification coefficients with the predetermined control algorithm such that the plurality of first products become equal to 0, calculating a plurality of second products by multiplying the plurality of first modification coefficients by the values of the plurality of respective predetermined first functions, respectively, and calculating the modification value using a total sum of the plurality of second products, and the plurality of predetermined first functions are associated with a plurality of regions formed by dividing a region within which the second operational state parameter is variable, respectively, and are set to values other than 0 in the associated regions and to 0 in regions other than the associated regions, each two adjacent regions overlapping each other, the plurality of predetermined first functions being set such that an absolute value of a total sum of respective values of ones of the first functions associated with the overlapping regions becomes equal to an absolute value of a maximum value of the first functions.

Further preferably, the second modification value-calculating step comprises a second sensitivity parameter-calculating step of calculating a second sensitivity parameter indicative of a sensitivity of the feedforward input to the first operational state parameter according to the first operational state parameter, a first modified product-calculating step of calculating a plurality of first modified products by modifying the plurality of first products using the second sensitivity parameter, and a first modification coefficient-calculating step of calculating a plurality of first modification coefficients with the predetermined control algorithm such that the plurality of first modified products become equal to 0.

Preferably, the feedforward input-calculating step comprises a model value-calculating step of calculating a model value of the feedforward input using the first operational state parameter and the correlation model, and an input-setting step of setting a product of the model value and the modification value as the feedforward input.

More preferably, the method further comprises a third operational state parameter-detecting step of detecting a third operational state parameter indicative of an operational state of the controlled object, except for the controlled variable, wherein the feedforward input-calculating step comprises a third modification value-calculating step of calculating a plurality of third products by multiplying a difference between the feedback correction value and the predetermined target value by values of a plurality of respective predetermined second functions, calculating a plurality of second modification coefficients with the predetermined control algorithm such that the plurality of third products become equal to 0, calculating a plurality of fourth products by multiplying the plurality of second modification coefficients by the values of the plurality of respective predetermined second functions, respectively, and calculating the modification value using a sum of a total sum of the plurality of fourth products and a predetermined value, and the plurality of predetermined second functions are associated with a plurality of regions formed by dividing a region within which the third operational state parameter is variable, respectively, and are set to values other than 0 in the associated regions and to 0 in regions other than the associated regions, each two adjacent regions overlapping each other, the plurality of predetermined second functions being set such that an absolute value of a total sum of respective values of ones of the second functions associated with the overlapping regions becomes equal to an absolute value of a maximum value of the second functions.

Further preferably, the first operational state parameter is formed by a plurality of operational state parameters indicative of operational states of the controlled object, and the third modification value-calculating step includes setting the sum of the total sum of the plurality of fourth products and a predetermined value to the modification value.

Further preferably, the third modification value-calculating step comprises a third sensitivity parameter-calculating step of calculating a third sensitivity parameter indicative of a sensitivity of the feedforward input to the first operational state parameter according to the first operational state parameter, a third modified product-calculating step of calculating a plurality of third modified products by modifying the respective plurality of third products using the third sensitivity parameter, and a second modification coefficient-calculating step of calculating the plurality of second modification coefficients with the predetermined control algorithm such that the plurality of third modified products become equal to 0.

Preferably, the controlled variable is an output from an exhaust gas concentration sensor for detecting a concentration of a predetermined component of exhaust gases in an exhaust passage of an internal combustion engine at a location downstream of a catalytic device, the target controlled variable being a target output at which an exhaust emission reduction rate of the catalytic device is estimated to be placed in a predetermined state, the controlled variable being an amount of fuel to be supplied to the engine, the first operational state parameter being an operating condition parameter indicative of an operating condition of the engine, the feedforward input being a basic value of the amount of fuel to be supplied to the engine, and the feedback correction value being a fuel correction coefficient which is calculated with the predetermined feedback control algorithm such that the output from the exhaust gas concentration sensor converges to the target output, and by which the basic value of the amount of fuel to be supplied to the engine is multiplied.

With the configurations of these preferred embodiments, it is possible to obtain the same advantageous effects as provided by the respective corresponding preferred embodiments of the first aspect of the present invention.

The above and other objects, features, and advantages of the present invention will become more apparent from the following detailed description taken in conjunction with the accompanying drawings.

DETAILED DESCRIPTION OF PREFERRED EMBODIMENTS

Figure 1:
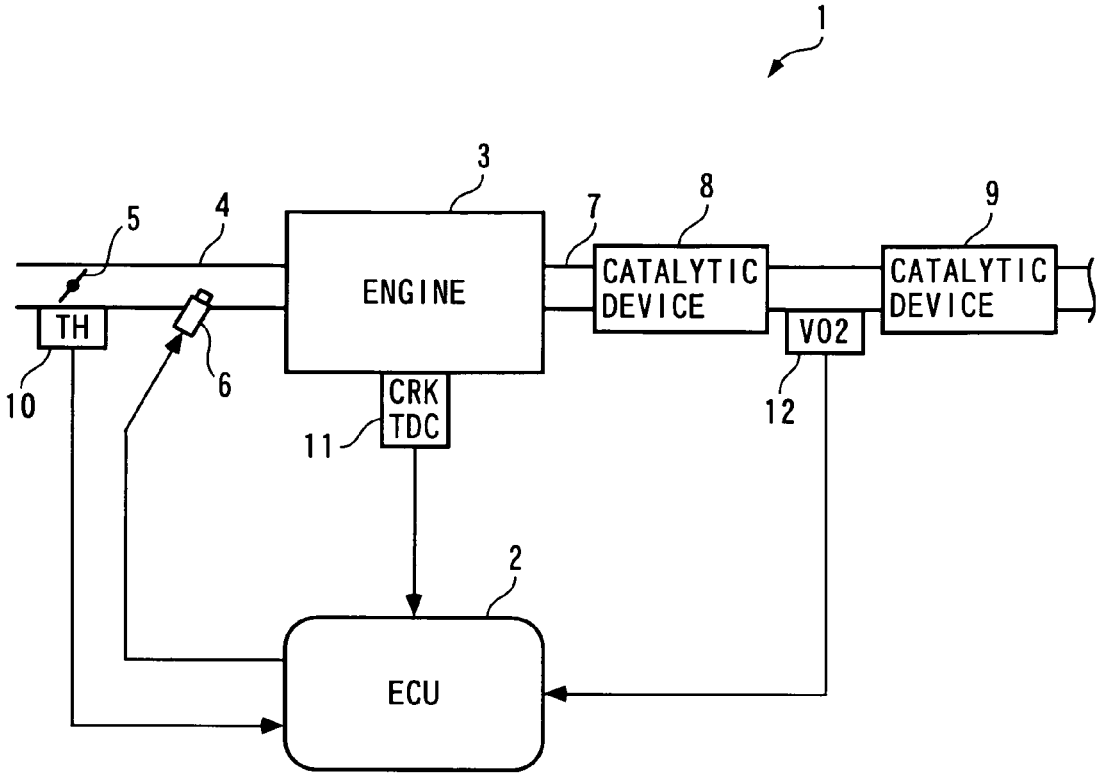
FIG. 1 is a schematic diagram of a control apparatus according to a first embodiment of the present invention, and an internal combustion engine to which is applied the control apparatus.

Hereafter, a control apparatus according to an embodiment of the present invention will be described with reference to the drawings. The control apparatus according to the present embodiment is for controlling the air-fuel ratio of a mixture to be supplied to an internal combustion engine. FIG. 1 is a schematic diagram of the control apparatus 1, and the internal combustion engine (hereinafter referred to as the "engine") 3 to which is applied the control apparatus. Referring to FIG. 1, the control apparatus 1 includes an ECU 2. As described hereinafter, the ECU 2 controls the air-fuel ratio of a mixture to be supplied to cylinders of the engine 3, according to operating states of the engine 3.

The engine 3 is a gasoline engine installed on a motorcycle, not shown, having a relatively small displacement. The engine 3 has an intake passage 4 much shorter than that of a general automotive engine, and an intake chamber having a volume set to a considerably smaller value than that of the intake chamber of the general automotive engine. The intake passage 4 has a throttle valve 5 and a fuel injection valve 6 inserted therein in this order from upstream to downstream.

The throttle valve 5 is pivotally disposed in an intermediate portion of the intake passage 4, and is connected to a throttle lever (not shown) via a gear mechanism (not shown) and a wire (not shown). The throttle valve 5 is pivotally moved according the operation of the throttle lever by a driver of the motorcycle to thereby change the flow rate of air flowing through the intake passage 4.

Further, a throttle valve opening sensor 10 is disposed in the vicinity of the throttle valve 5 in the intake passage 4. The throttle valve opening sensor 10 is implemented e.g. by a potentiometer, and detects the opening TH of the throttle valve 5 (hereinafter referred to as the "throttle valve opening TH") to deliver a signal indicative of the detected throttle valve opening TH to the ECU 2. The ECU 2 calculates the throttle valve opening TH based on the signal from the throttle valve opening sensor 10. It should be noted that in the present embodiment, the throttle valve opening sensor 10 corresponds to first to third operational state parameter-detecting means, and the throttle valve opening TH corresponds to first to third operational state parameters, an operational state parameter, and an operating condition parameter.

Furthermore, during operation of the engine, the fuel injection valve 6 is controlled in respect of a fuel injection amount Tout, i.e. a time period over which the fuel injection valve 6 is open, and fuel injection timing, by a control signal delivered from the ECU 2.

On the other hand, the engine 3 has a crankshaft (not shown) provided with a crank angle sensor 11. The crank angle sensor 11 delivers a CRK signal and a TDC signal, which are both pulse signals, to the ECU 2 in accordance with rotation of the crankshaft. The TDC signal indicates that each piston (not shown) in an associated one of the cylinders is in a predetermined crank angle position slightly before the TDC position at the start of the intake stroke, and one pulse thereof is delivered whenever the crankshaft rotates through a predetermined crank angle.

One pulse of the CRK signal is delivered whenever the crankshaft rotates through a predetermined angle (e.g. 30°). The ECU 2 calculates the rotational speed NE of the engine 3 (hereinafter referred to as the "engine speed NE") based on the CRK signal. It should be noted that in the present embodiment, the crank angle sensor 11 corresponds to first operational state parameter-detecting means, and the engine speed NE corresponds to the first operational state parameter, the operational state parameter, and the operating condition parameter.

On the other hand, a first catalytic device 8 and a second catalytic device 9 are provided in an exhaust passage 7 of the engine 3 in this order from upstream to downstream. Each of the catalytic devices 8 and 9 is a combination of a NOx catalyst and a three-way catalyst, and eliminates NOx from exhaust gases emitted during a lean burn operation of the engine 3 by oxidation-reduction catalytic actions of the NOx catalyst, and CO, HC, and NOx from exhaust gases emitted during other operations of the engine 3 than the lean burn operation by oxidation-reduction catalytic actions of the three-way catalyst.

An oxygen concentration sensor (hereinafter also referred to as the "O2 sensor") 12 is inserted into the exhaust passage 7 between the first and second catalytic devices 8 and 9. The O2 sensor 12 is comprised of a zirconia layer and platinum electrodes, and detects the concentration of oxygen contained in exhaust gases downstream of the first catalytic device 8, to deliver a signal indicative of the detected oxygen concentration to the ECU 2. An output VO2 from the O2 sensor 12 (hereinafter referred to as the "sensor output VO2") assumes a high-level voltage value (e.g. 0.8 V) when an air-fuel mixture having a richer air-fuel ratio than the stoichiometric air-fuel ratio has been burned, whereas it assumes a low-level voltage value (e.g. 0.2 V) when an air-fuel mixture having a leaner air-fuel ratio than the stoichiometric air-fuel ratio has been burned. Further, when the air-fuel ratio of the mixture is close to the stoichiometric air-fuel ratio, the sensor output VO2 becomes equal to a predetermined target output VO2_TRGT (e.g. 0.6 V) between the high-level and low-level voltage values.

Figure 2:
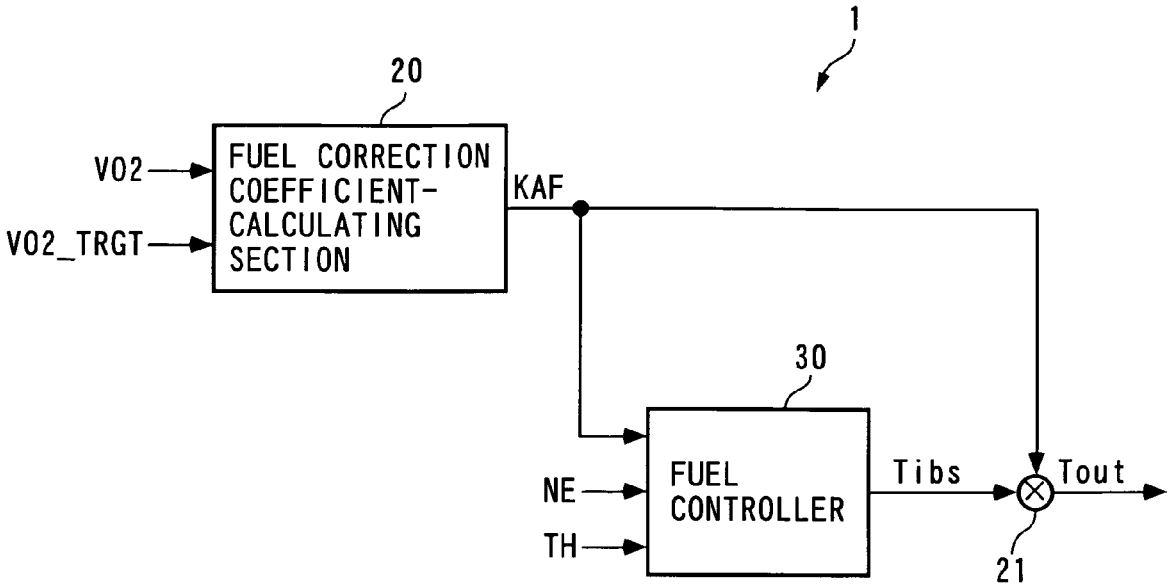
FIG. 2 is a schematic functional block diagram of the control apparatus.

The present assignee has already confirmed that with the above-described configuration, when the sensor output VO2 is equal to the target output VO2_TRGT, the first catalytic device 8 eliminates HC and NOx from exhaust gases most efficiently irrespective of whether or not the first catalytic device 8 is in a degraded state (see e.g. FIG. 2 in the publication of Japanese Patent No. 3904923). Therefore, if the air-fuel ratio of the mixture is controlled such that the sensor output VO2 becomes equal to the target output VO2_TRGT, the first catalytic device 8 can reduce exhaust emissions most efficiently, and hence in the air-fuel ratio control, described hereinafter, a fuel correction coefficient KAF is calculated such that the sensor output VO2 converges to the target output VO2_TRGT.

It should be noted that in the present embodiment, the O2 sensor 12 corresponds to controlled variable-detecting means and an exhaust gas concentration sensor, the output VO2 from the O2 sensor 12 to a controlled variable and an output from the exhaust gas concentration sensor, and the target output VO2_TRGT to a target controlled variable.

The ECU 2 is implemented by a microcomputer comprised of a CPU, a RAM, a ROM, and an I/O interface, (none of which are shown). The ECU 2 determines operating conditions of the engine 3 based on the signals from the aforementioned sensors 10 to 12, and carries out various control processes. More specifically, as described hereinafter, the ECU 2 calculates the fuel correction coefficient KAF according to operating conditions of the engine 3, and further calculates the fuel injection amount Tout and fuel injection timing of the fuel injection valve 6 based on the fuel correction coefficient KAF. Then, the ECU 2 causes the fuel injection valve 6 to be driven by a control signal generated based on the calculated fuel injection amount Tout and fuel injection timing, to thereby control the air-fuel ratio of the mixture.

It should be noted that in the present embodiment, the ECU 2 corresponds to target controlled variable-setting means, feedback correction value-calculating means, the first to third operational state parameter-detecting means, feedforward input-calculating means, control input-calculating means, modified operational state parameter-calculating means, input-calculating means, first to third sensitivity parameter-calculating means, first modification difference-calculating means, first to third modification value-calculating means, first and second modification product-calculating means, first and second modification coefficient-calculating means, model value-calculating means, and input-setting means.

Next, the control apparatus 1 according to the present embodiment will be described with reference to FIG. 2. As shown in FIG. 2, the control apparatus 1 is comprised of a fuel correction coefficient-calculating section 20, a multiplier 21, and a fuel controller 30. These component elements are all implemented by the ECU 2.

First, the fuel correction coefficient-calculating section 20 calculates the fuel correction coefficient KAF with a sliding mode control algorithm expressed by the following equations (1) to (5). This fuel correction coefficient KAF is calculated as an equivalent ratio.

$$Eaf(k) = V02(k) - V02_\mathrm{TRGT} \tag{1}$$

$$\sigma(k) = Eaf(k) + S \cdot Eaf(k-1) \tag{2}$$

$$Urch(k) = Krch \cdot \sigma(k) \tag{3}$$

$$Uadp(k) = Kadp \cdot \sum_{j=0}^{k} \sigma(j) \tag{4}$$

$$KAF(k) = Urch(k) + Uadp(k) \tag{5}$$

In the above equations (1) to (5), data with a symbol (k) indicates that it is discrete data calculated or sampled at a predetermined control period ΔT (a repetition period at which the TDC signal is generated). The symbol k indicates a control time point at which respective discrete data is calculated. For example, the symbol k indicates that discrete data therewith is a value calculated (or sampled) in the current control timing, and a symbol k−1 indicates that discrete data therewith is a value calculated in the immediately preceding control timing. This also applies to discrete data referred to hereinafter. Further, in the following description, the symbol (k) to be added to the discrete data is omitted as deemed appropriate.

As shown in the above equation (1), a follow-up error Eaf is calculated as the difference between the sensor output VO2 and the target output VO2_TRGT. Further, in the above equation (2), a represents a switching function, and S represents a switching function-setting parameter set to a value which satisfies the relationship of $-1<S<0$. In this case, the convergence rate of the follow-up error Eaf to 0, i.e. the convergence rate of the sensor output VO2 to the target output VO2_TRGT is designated by a value set to the switching function-setting parameter S. Further, in the above equation (3), Urch represents a reaching law input, and Krch represents a predetermined reaching law gain. Furthermore, in the above equation (4), Uadp represents an adaptive law input, and Kadp represents a predetermined adaptive law gain.

The fuel correction coefficient-calculating section 20 calculates the fuel correction coefficient KAF with the sliding mode control algorithm described above, such that the sensor output VO2 is caused to converge to the target output VO2_TRGT, and as an equivalent ratio. Therefore, when VO2≈VO2_TRGT holds, if no mapping error is caused, KAF≈1 holds, whereas if a mapping error is caused, KAF deviates from 1. It should be noted that in the present embodiment, the fuel correction coefficient-calculating section 20 corresponds to the feedback correction value-calculating means, the fuel correction coefficient KAF to a feedback correction value, and the sliding mode control algorithm to a predetermined feedback control algorithm.

The fuel controller 30 calculates a basic fuel injection amount Tibs by a method, described hereinafter, according to the fuel correction coefficient KAF, the engine speed NE, and the throttle valve opening TH. The multiplier 21 calculates the fuel injection amount Tout by the following equation:

$$Tout(k)=KAF(k)\cdot Tibs(k) \tag{6}$$

As shown in the above equation, the fuel injection amount Tout is calculated by correcting the basic fuel injection amount Tibs using the fuel correction coefficient KAF, and as described above, and the fuel correction coefficient KAF is calculated such that the sensor output VO2 is caused to converge to the target output VO2_TRGT. Therefore, by using the fuel injection amount Tout calculated as above, the air-fuel ratio of the mixture is controlled such that the sensor output VO2 converges to the target output VO2_TRGT.

It should be noted that in the present embodiment, the multiplier 21 corresponds to the control input-calculating means, the fuel injection amount Tout to the control input and a fuel supply amount, the fuel controller 30 to the feedforward input-calculating means, and the basic fuel injection amount Tibs corresponds to a feedforward input and the basic value of the fuel supply amount.

Figure 3:
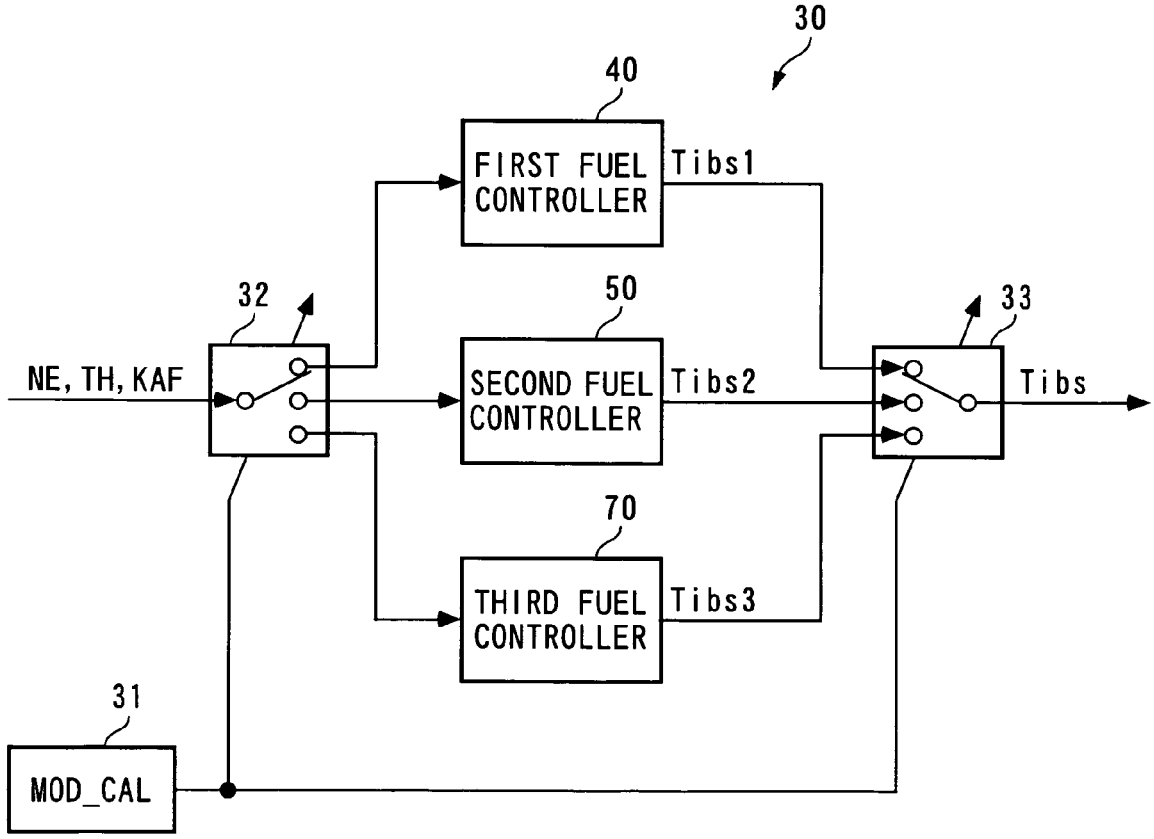
FIG. 3 is a schematic functional block diagram of a fuel controller.

Next, the above-mentioned fuel controller 30 will be described with reference to FIG. 3. As shown in FIG. 3, the fuel controller 30 is comprised of a calculation mode value-generating section 31, a controller-switching section 32, an output selecting section 33, and first to third controllers 40, 50, and 70.

The calculation mode value-generating section 31 delivers a calculation mode value MOD_CAL to the controller-switching section 32 and the output selecting section 33. The calculation mode value MOD_CAL is set in advance to any of 1 to 3 at the time of shipment from a factory, based on the kind of a mapping error which is liable to occur with the engine 3. More specifically, the calculation mode value MOD_CAL is set to 1 when a mapping error is liable to be caused by the aforementioned offset displacement, and is set to 2 when a mapping error is liable to be caused by the aforementioned temperature drift. Further, the calculation mode value MOD_CAL is set to 3 when a mapping error is liable to be caused by the aforementioned sludge accumulation.

Further, the controller-switching section 32 inputs the three values NE, TH, and KAF to one of the three controllers 40, 50, and 70 in a manner switching between them according to the calculation mode value MOD_CAL. More specifically, the three values NE, TH, and KAF are input to the first fuel controller 40 when MOD_CAL=1 holds, to the second fuel controller 50 when MOD_CAL=2 holds, and to the third fuel controller 70 when MOD_CAL=3 holds.

Furthermore, the first to third controllers 40, 50, and 70 calculate first to third basic injection amounts Tibs1 to Tibs3 by respective methods, described hereinafter.

The output selecting section 33 selects and outputs one of the first to third basic injection amounts Tibs1 to Tibs3 calculated by the associated one of the controllers 40, 50, and 70, as the basic fuel injection amount Tibs according to the calculation mode value MOD_CAL. More specifically, when MOD_CAL=1 holds, the first basic injection amount Tibs1 is output as the basic fuel injection amount Tibs, and when MOD_CAL=2 holds, the second basic injection amount Tibs2 is output as the basic fuel injection amount Tibs. Further, when MOD_CAL=3 holds, the third basic injection amount Tibs3 is output as the basic fuel injection amount Tibs.

Next, a description will be given of the first fuel controller 40. The first fuel controller 40 calculates the first basic injection amount Tibs1 while compensating for the mapping error caused by the offset displacement, by a method described hereafter. It should be noted that in the present embodiment, the first fuel controller 40 corresponds to the feedforward input-calculating means and the modified operational state parameter-calculating means, and the first basic injection amount Tibs1 corresponds to the feedforward input and the basic value of the fuel supply amount.

Figure 4:
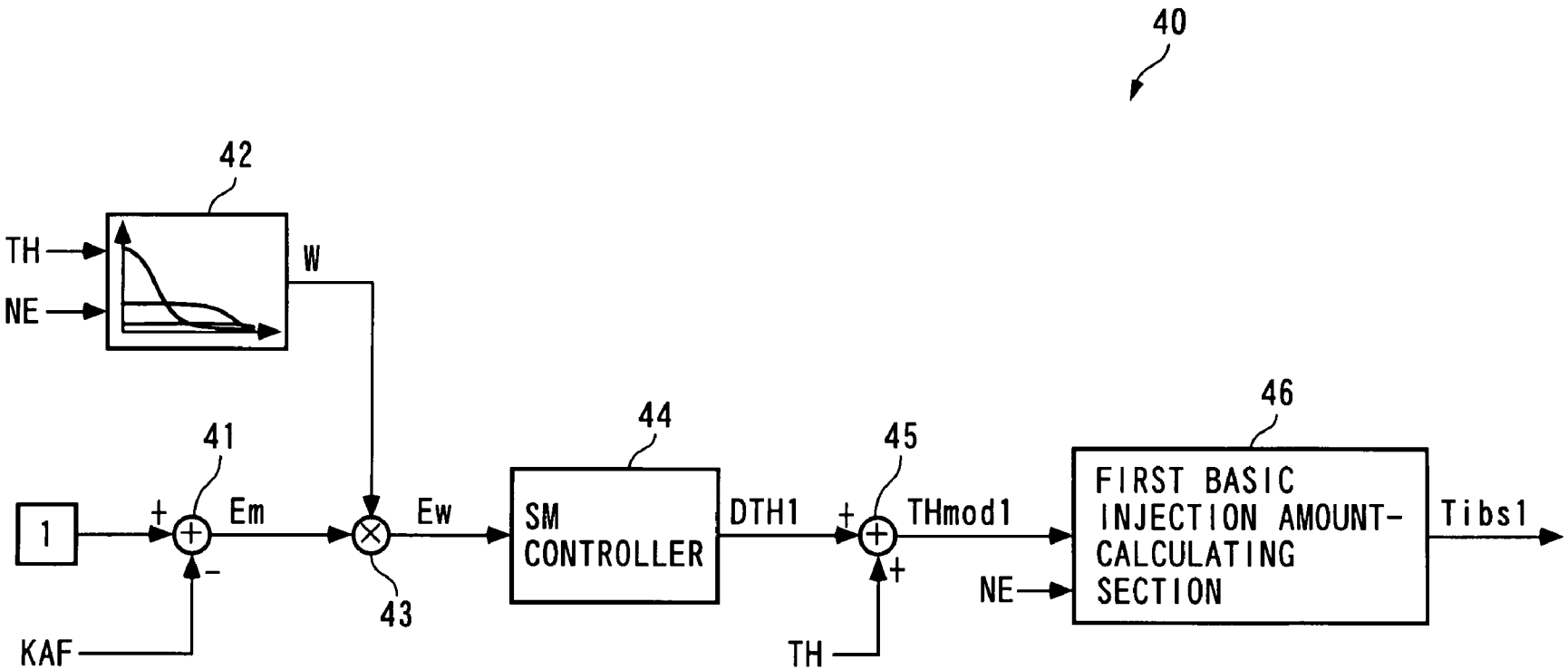
FIG. 4 is a schematic functional block diagram of a first fuel controller.

As shown in FIG. 4, the first fuel controller 40 is comprised of a subtractor 41, a weight-calculating section 42, a multiplier 43, an SM (Sliding Mode) controller 44, an adder 45, and a first basic injection amount-calculating section 46.

First, the subtractor 41 calculates a modeling error Em by the following equation (7):

$$Em(k)=1-KAF(k-1) \tag{7}$$

Now, as described hereinabove, when VO2≈VO2_TRGT holds, if no mapping error is caused, KAF becomes approximately equal to 1, whereas if a mapping error is caused, KAF deviates from 1, so that the modeling error Em represents the degree of deviation of the sensor output VO2 from the target output VO2_TRGT. It should be noted that in the present embodiment, the modeling error Em corresponds to the difference between the feedback correction value and a predetermined target value, and 1 corresponds to the predetermined target value.

Figure 5:
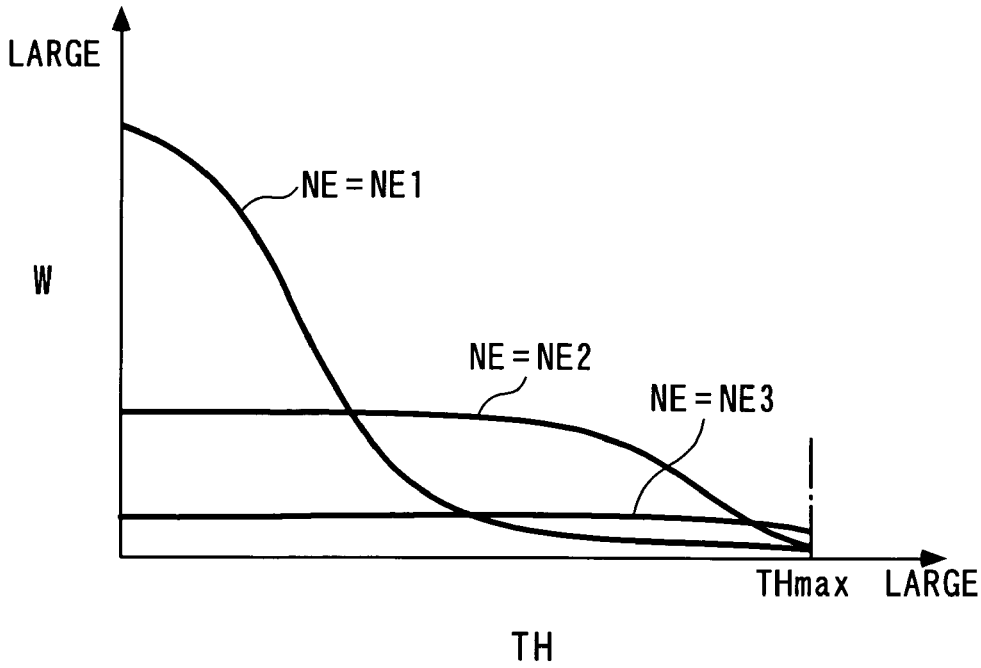
FIG. 5 is a diagram showing an example of a response surface map for use in calculating a weight W.

Further, the weight-calculating section 42 calculates a weight W by searching a response surface map shown in FIG. 5, according to the throttle valve opening TH and the engine speed NE. It should be noted that in the present embodiment, the weight-calculating section 42 corresponds to the first sensitivity parameter-calculating means, and the weight W corresponds to first to third sensitivity parameters. In FIG. 5, NE1 to NE3 represent predetermined values of the engine speed NE, which satisfy the relationship of NE1<NE2<NE3 holds. THmax represents a wide-open throttle value, and corresponds to the throttle valve opening TH obtained when the throttle valve 5 is in a fully-open state. This also applies to the following description. It should be noted that the meaning of the weight W will be described hereinafter.

Furthermore, the multiplier 43 calculates a correction modeling error Ew by the following equation (8). It should be noted that in the present embodiment, the multiplier 43 corresponds to first modified difference-calculating means, and the correction modeling error Ew corresponds to a first modified difference.

$$Ew(k)=W(k)\cdot Em(k) \tag{8}$$

Next, the SM controller 44 calculates a first opening correction value DTH1 with a sliding mode control algorithm expressed by the following equations (9) to (12):

$$\sigma v(k) = Ew(k) + Sv\cdot Ew(k-1) \tag{9}$$

$$\mathrm{Urch_v}(k) = \mathrm{Krch_v}\cdot\sigma v(k) \tag{10}$$

$$\mathrm{Uadp_v}(k) = \mathrm{Kadp_v}\cdot\sum_{j=0}^{k}\sigma v(j) \tag{11}$$

$$DTH1(k) = \mathrm{Urch_v}(k) + \mathrm{Uadp_v}(k) \tag{12}$$

In the above equation (9), σv represents a switching function, and Sv represents a switching function-setting parameter set to a value which satisfies the relationship of −1<Sv<0. In this case, the convergence rate of the correction modeling error Ew to 0 (i.e. the convergence rate of the fuel correction coefficient KAF to 1) is designated by a value set as the switching function-setting parameter Sv. Further, in the above equation (10), Urch_v represents a reaching law input, and Krch_v represents a predetermined reaching law gain. Furthermore, in the above equation (11), Uadp_v represents an adaptive law input, and Kadp_v represents a predetermined adaptive law gain.

As described above, the SM controller 44 calculates the first opening correction value DTH1 with the sliding mode control algorithm as a value for causing the correction modeling error Ew to converge to 0. In this case, although the first opening correction value DTH1 may be calculated with a feedback control algorithm other than the sliding mode control algorithm, a response-specifying control algorithm, differently from a feedback control algorithm other than the same, is capable of exponentially designating the convergence behavior of the correction modeling error Ew to 0, whereby it is possible to prevent interference with control (sliding mode control) executed by the fuel correction coefficient-calculating section 20.

For the above reason, in the present embodiment, the first opening correction value DTH1 is calculated with the sliding mode control algorithm, which is a response-specifying control algorithm. Now, when the first opening correction value DTH1 is calculated with another response-specifying control algorithm in pace of the above-described sliding mode control algorithm, i.e. even when the first opening correction value DTH1 is calculated with a back stepping control algorithm, or a control algorithm derived by replacing a controlled object model of the sliding mode control algorithm by a controlled object model of a linear system, it is possible to obtain the above-described advantageous effects. It should be noted that in the present embodiment, the SM controller 44 corresponds to first modification value-calculating means, and the first opening correction value DTH1 corresponds to a modification value.

Next, the adder 45 calculates a first corrected opening THmod1 (modified operational state parameter) by the following equation (13):

$$TH\mathrm{mod}1(k)=TH(k)+DTH1(k-1) \quad (13)$$

Figure 6:
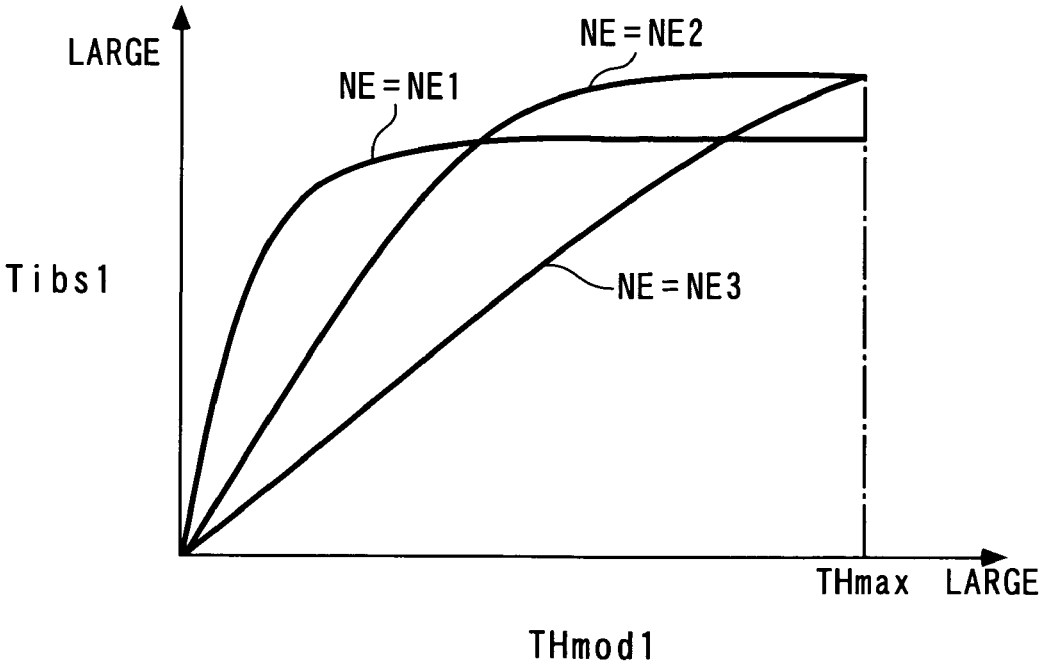
FIG. 6 is a diagram showing an example of a map for use in calculating a first basic injection amount Tibs1.
Figure 7:
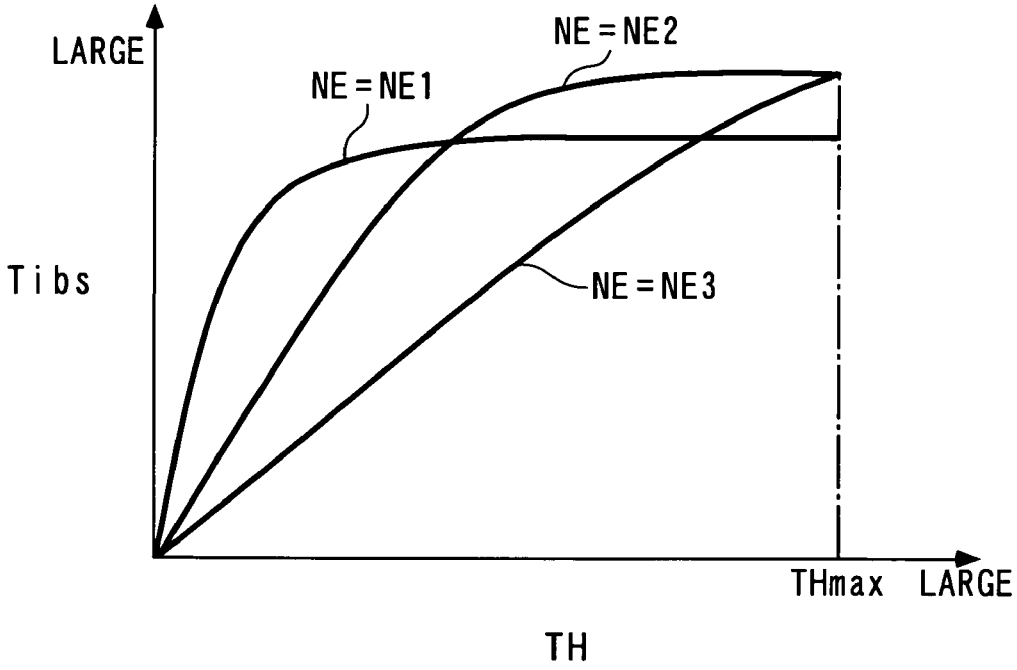
FIG. 7 is a diagram showing an example of a map formed by mapping the relationship between a basic injection amount Tibs, a throttle valve opening TH, and an engine speed NE.

Then, the first basic injection amount-calculating section 46 (input-calculating means) calculates the first basic injection amount Tibs1 by searching a map shown in FIG. 6 according to the first corrected opening THmod1 and the engine speed NE. The map shown in FIG. 6 is formed by replacing the basic injection amount Tibs set to the vertical axis of the map in FIG. 7 by the first basic injection amount Tibs1, and replacing the throttle valve opening TH set to the horizontal axis of the same by the first corrected opening THmod1. FIG. 7 is obtained by mapping the relationship between the throttle valve opening TH and the engine speed NE, and the basic injection amount Tibs (=Tout) when the engine 3 is being operated in a state where the fuel correction coefficient KAF=1 holds (i.e. when the air-fuel ratio of the mixture is equal to the stoichiometric air-fuel ratio).

Figure 8:
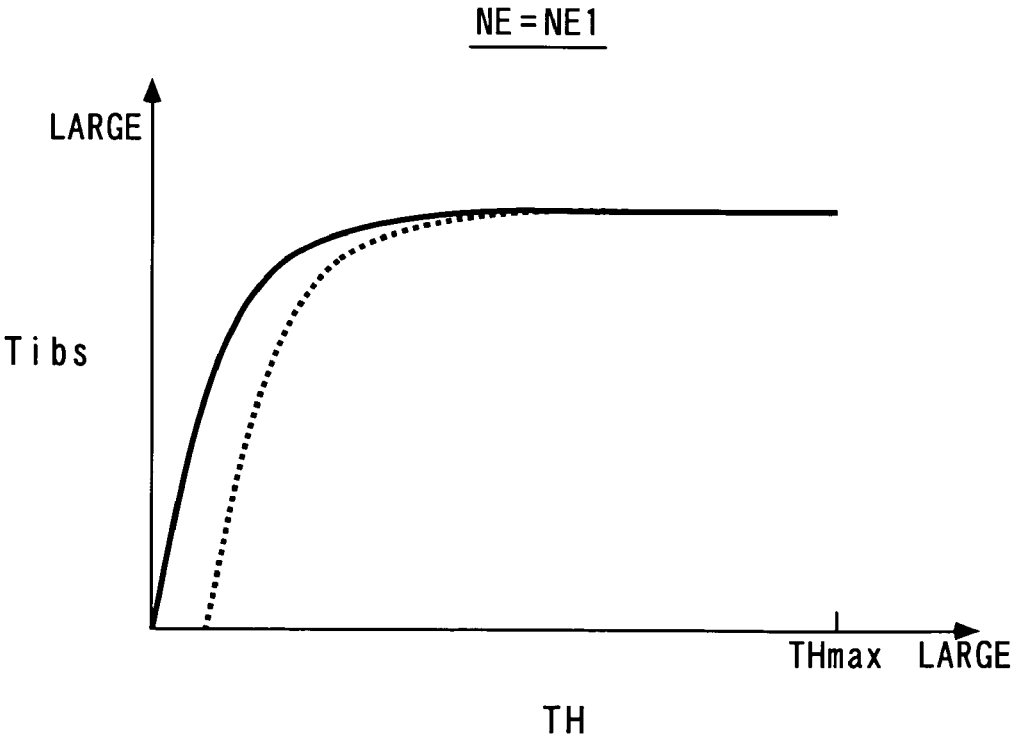
FIG. 8 is a diagram which is useful in explaining a mapping error due to offset displacement.

Next, the reason why the first fuel controller 40 calculates the first basic injection amount Tibs1 by the above-described calculation method will be described with reference to FIG. 8. In FIG. 8, a curve indicated by a solid line represents map values of the basic injection amount Tibs obtained when NE=NE1 holds in FIG. 7, and a curve indicated by a broken line represents an example in which the relationship between an appropriate value (required value) of the basic injection amount Tibs and the throttle valve opening TH deviates from the relationship between the map values and the throttle valve opening TH due to offset displacement, i.e. when a mapping error is caused by the offset displacement.

When a mapping error is caused by the offset displacement as shown in FIG. 8, the sensor output VO2 deviates from the target output VO2_TRGT, resulting in increased exhaust emissions. Therefore, to ensure excellent reduction of exhaust emissions, it is necessary to eliminate the mapping error. In this case, since the mapping error is caused by the offset displacement, it is only required that the basic injection amount Tibs is calculated using a value obtained by decreasing or increasing the throttle valve opening TH by the amount of the offset displacement. Therefore, to compensate for the mapping error caused by the offset displacement of the throttle valve opening TH, the first fuel controller 40 calculates the first corrected opening THmod1 by correcting the throttle valve opening TH using the first opening correction value DTH1, which is an addition term, and calculates the first basic injection amount Tibs1 using the thus calculated first corrected opening THmod1.

Further, the aforementioned weight W is used for the following reason: When the above-described follow-up error Eaf (=VO2−VO2_TRGT) is caused during execution of the air-fuel control by the control apparatus 1, thereby causing a modeling error Em, the probability of occurrence of the modeling error Em due to the above-described offset displacement becomes higher as the amount of change in the basic injection amount Tibs with respect to change in the throttle valve opening TH is larger. In other words, in the above-described FIG. 7 map, the probability of the offset displacement causing the modeling error Em becomes higher as the gradient of the curve indicating the basic injection amount Tibs is larger.

Figure 9:
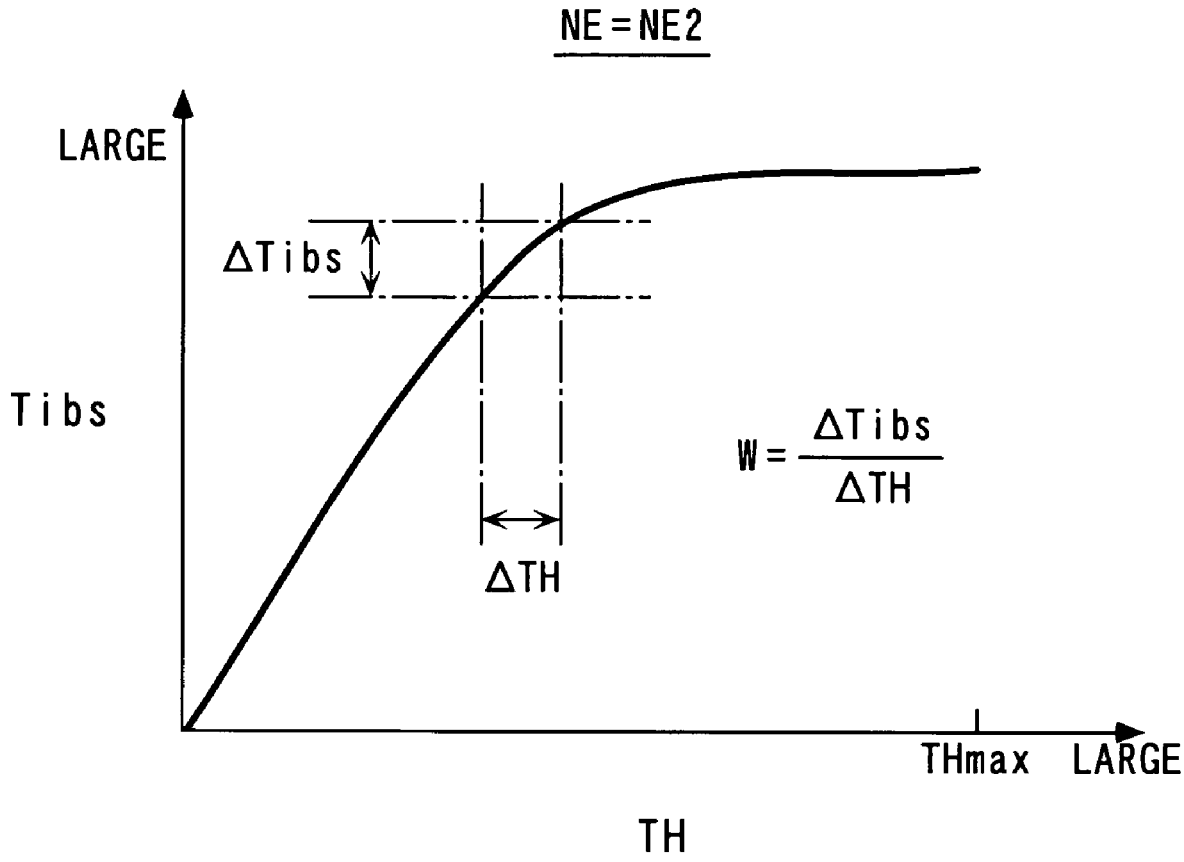
FIG. 9 is a diagram which is useful in explaining the meaning of the weight W.

Now, as shown in FIG. 9, when the throttle valve opening TH changes by a predetermined amount ΔTH (e.g. 1 degree), if the amount of change in the basic injection amount Tibs is represented by ΔTibs, the gradient of the curve indicating the basic injection amount Tibs is represented by ΔTibs/ΔTH. As described hereinabove, the probability of the offset displacement causing the modeling error Em becomes higher as the gradient ΔTibs/ΔTH is larger, and hence if the gradient is set as the weight W (W=ΔTibs/ΔTH), and the weight W is calculated based on the map shown in FIG. 7, the response surface map shown in FIG. 5 is obtained. As described above, the weight W is calculated as a representation of the sensitivity of the basic injection amount Tibs to the throttle valve opening TH. Further, as described above, the correction modeling error Ew is calculated by multiplying the modeling error Em by the weight W and the first opening correction value DTH1 is calculated such that the correction modeling error Ew becomes equal to 0, whereby it is possible to calculate the first opening correction value DTH1 while causing whether the probability of the offset displacement causing the modeling error Em is higher or lower to be reflected thereon.

Further, the first corrected opening THmod1 is calculated by correcting the throttle valve opening TH using the first opening correction value DTH1 calculated as above, and the first basic injection amount Tibs1 is calculated using the first corrected opening THmod1. This makes it possible to calculate the first basic injection amount Tibs1 while compensating for the mapping error caused by the offset displacement quickly and properly.

Next, a description will be given of the second fuel controller 50. The second fuel controller 50 calculates the second basic injection amount Tibs2 while compensating for a mapping error caused by the aforementioned temperature drift, by a method described hereafter. It should be noted that in the present embodiment, the second fuel controller 50 corresponds to the feedforward input-calculating means, the modified operational state parameter-calculating means, and the second modification value-calculating means, and the second basic injection amount Tibs2 corresponds to the feedforward input and the basic value of the fuel supply amount.

Figure 10:
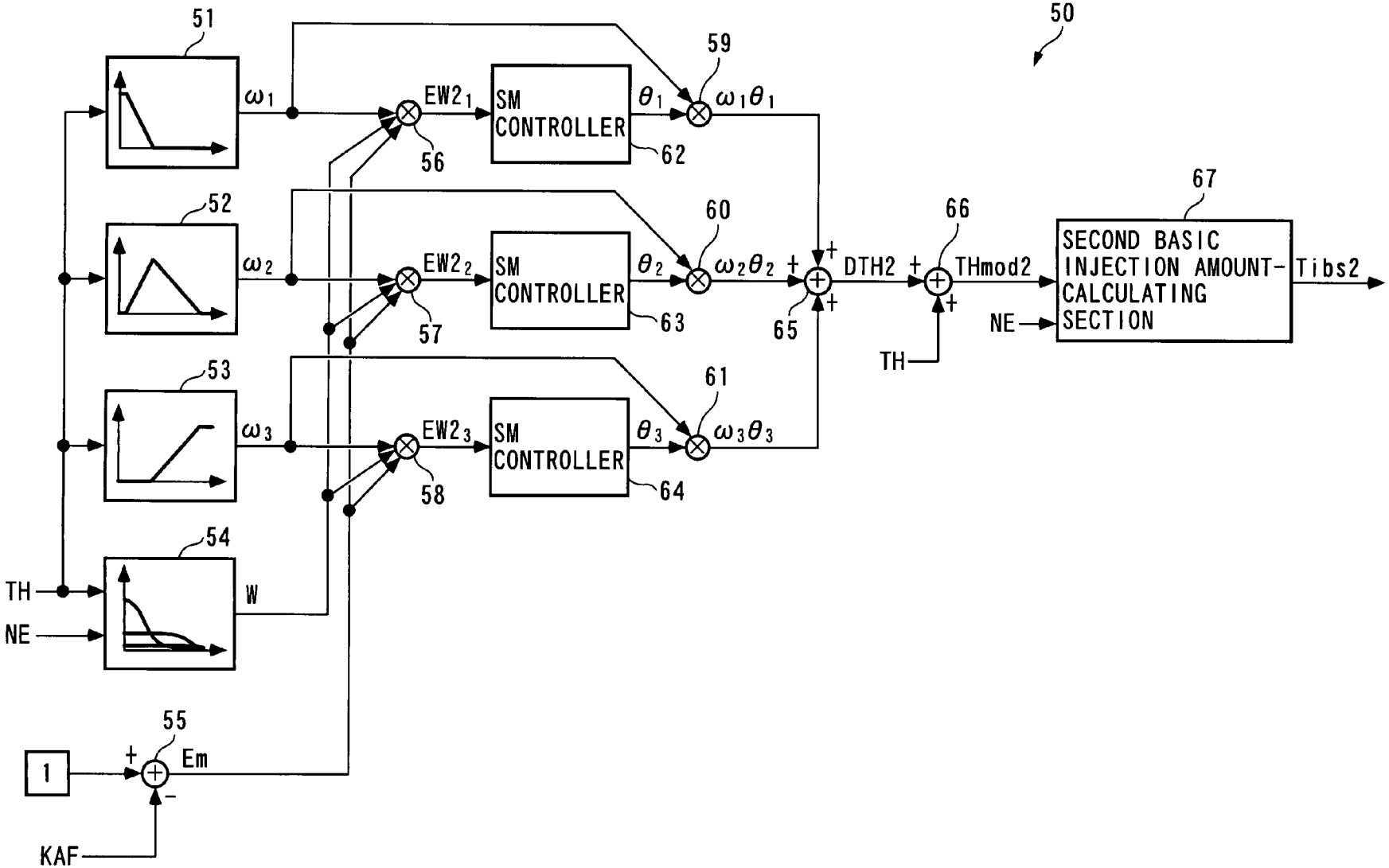
FIG. 10 is a schematic functional block diagram of a second fuel controller.

Referring to FIG. 10, the second fuel controller 50 is comprised of three coupling function-calculating sections 51 to 53, a weight-calculating section 54, a subtractor 55, six multipliers 56 to 61, three SM controllers 62 to 64, two adders 65 and 66, and a second basic injection amount-calculating section 67.

Figure 11:
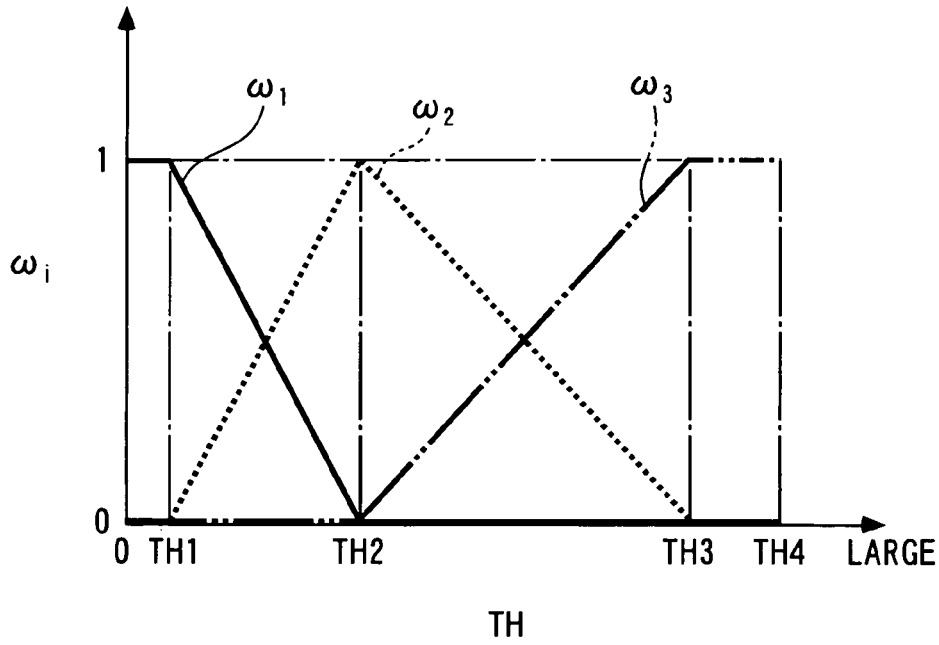
FIG. 11 is a diagram showing an example of a map for use in calculating a coupling function $\omega_i$.

First, the three coupling function-calculating sections 51 to 53 calculate the respective values of three coupling functions $\omega_i$ (i=1 to 3) by searching a map shown in FIG. 11 according to the throttle valve opening TH. In FIG. 11, TH1 to TH4 represent predetermined values of the throttle valve opening TH, which are set such that 0<TH1<TH2<TH3<TH4 (=THmax) holds.

The subscript i of the coupling function $\omega_i$ indicates that the value of the coupling function $\omega_i$ corresponds to one of three regions of the throttle valve opening TH, described hereinafter. This relationship also applies to various values, described hereinafter. More specifically, a coupling function $\omega_1$ is associated with a first region defined as 0≦TH<TH2; a coupling function $\omega_2$ is associated with a second region defined as TH1<TH<TH3; and a coupling function $\omega_3$ is associated with a third region defined as TH2<TH3.

Further, as shown in FIG. 10, each of the three coupling functions $\omega_i$ is set to a positive value not larger than 1 in the above-described regions associated therewith, and is set to 0 in the other regions. Further, the three coupling functions $\omega_i$ are configured such that two adjacent coupling functions $\omega_m$ and $\omega_{m+1}$ (m=1 or 2) intersect with each other, and the sum of the values of intersecting points of the two adjacent coupling functions is equal to the maximum value 1 of the coupling functions $\omega_i$. It should be noted that in the present embodiment, the coupling functions $\omega_i$ corresponds to first and second functions.

On the other hand, similarly to the weight-calculating section 42, the weight-calculating section 54 calculates the weight W by searching the response surface map shown in FIG. 5 according to the throttle valve opening TH and the engine speed NE. It should be noted that in the present embodiment, the weight-calculating section 54 corresponds to the second and third sensitivity parameter-calculating means, and the weight W corresponds to the second and third sensitivity parameters.

Further, similarly to the above-mentioned subtractor 41, the subtractor 55 calculates the modeling error Em by the aforementioned equation (7).

Furthermore, the three multipliers 56 to 58 calculate three second correction modeling errors $Ew2_i$ by the following equation (14). It should be noted that in the present embodiment, the three multipliers 56 to 58 correspond to the first and second modification product-calculating means, and the second correction modeling errors $Ew2_i$ correspond to first and second modification products.

$$Ew2_i(k)=\omega_i(k)\cdot W(k)\cdot Em(k) \tag{14}$$

Next, the three SM controllers 62 to 64 calculate three modification coefficients $\theta_i$ with a sliding mode control algorithm expressed by the following equations (15) to (18).

$$\sigma v2_i(k) = Ew2_i(k) + Sv2\cdot Ew2_i(k-1) \tag{15}$$

$$\mathrm{Urch_v2}_i(k) = \mathrm{Krch_v2}\cdot \sigma v2_i(k) \tag{16}$$

$$\mathrm{Uadp_v2}_i(k) = \mathrm{Kadp_v2}\cdot \sum_{j=0}^{k} \sigma v2_i(k) \tag{17}$$

$$\theta_i(k) = \mathrm{Urch_v2}_i(k) + \mathrm{Uadp_v2}_i(k) \tag{18}$$

In the above equation (15), σv2 represents a switching function, and Sv2 represents a switching function-setting parameter set to a value which satisfies the relationship of $-1<Sv2<0$. In this case, the convergence rate of the second correction modeling error $Ew2_i$ to 0 is designated by a value set to the switching function-setting parameter Sv2. Further, in the above equation (16), Urch_v2 represents a reaching law input, and Krch_v2 represents a predetermined reaching law gain. Furthermore, in the above equation (17), Uadp_v2 represents an adaptive law input, and Kadp_v2 represents a predetermined adaptive law gain.

As described above, the SM controllers 62 to 64 calculate the three modification coefficients $\theta_i$ with the sliding mode control algorithm as values for causing the three second correction modeling errors $Ew2_i$ to converge to 0, respectively. It should be noted that in the present embodiment, the SM controllers 62 to 64 correspond to the first and second modification coefficient-calculating means, and the modification coefficients $\theta_i$ correspond to first and second modification coefficients.

Next, the three multipliers 56 to 61 calculate three products $\theta_i\cdot\omega_i$ (second and fourth products) by multiplying the three modification coefficients $\theta_i$ by the three coupling functions $\omega_i$, respectively.

Further, the adder 65 calculates a second opening correction value DTH2 (modification value) as the sum of the three products $\theta_i\cdot\omega_i$.

$$DTH2(k) = \sum_{i=1}^{3} \omega_i(k)\cdot\theta_i(k) \tag{19}$$

Next, the adder 66 calculates a second corrected opening THmod2 (modified operational state parameter) by the following equation (20):

$$TH\mathrm{mod}2(k)=TH(k)+DTH2(k-1) \tag{20}$$

Figure 12:
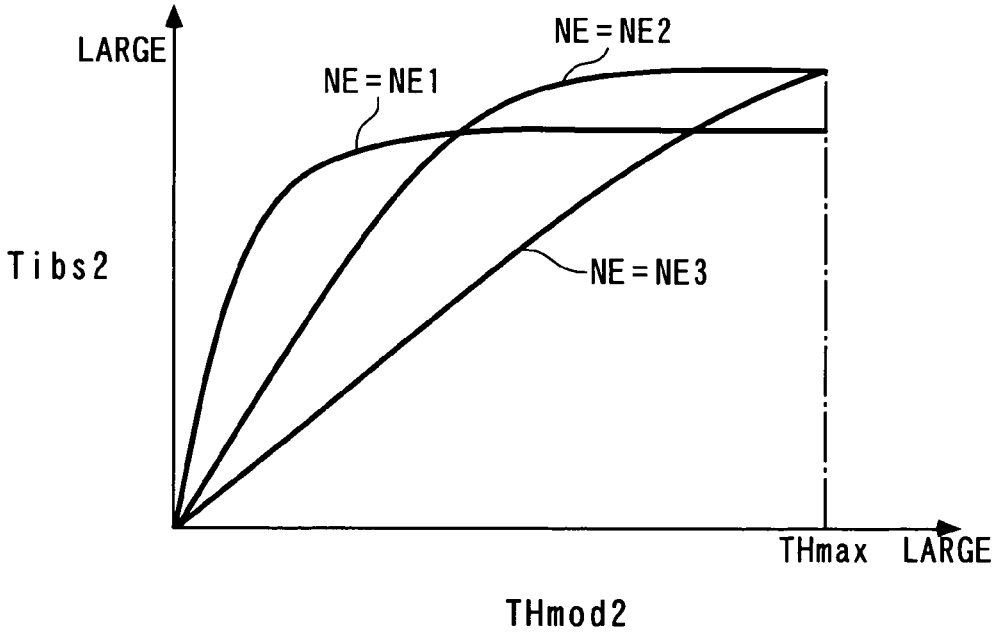
FIG. 12 is a diagram showing an example of a map for use in calculating a second basic injection amount Tibs2.

[Then, the second basic injection amount-calculating section 67 (input calculating means) calculates the second basic injection amount Tibs2 by searching a map shown in FIG. 12 according to the second corrected opening THmod2 and the engine speed NE. The map shown in FIG. 12 corresponds to a map formed by replacing the basic injection amount Tibs set to the vertical axis of the map shown in FIG. 7 by the second basic injection amount Tibs2, and replacing the throttle valve opening TH set to the horizontal axis of the same by the second corrected opening THmod2.

Figure 13:
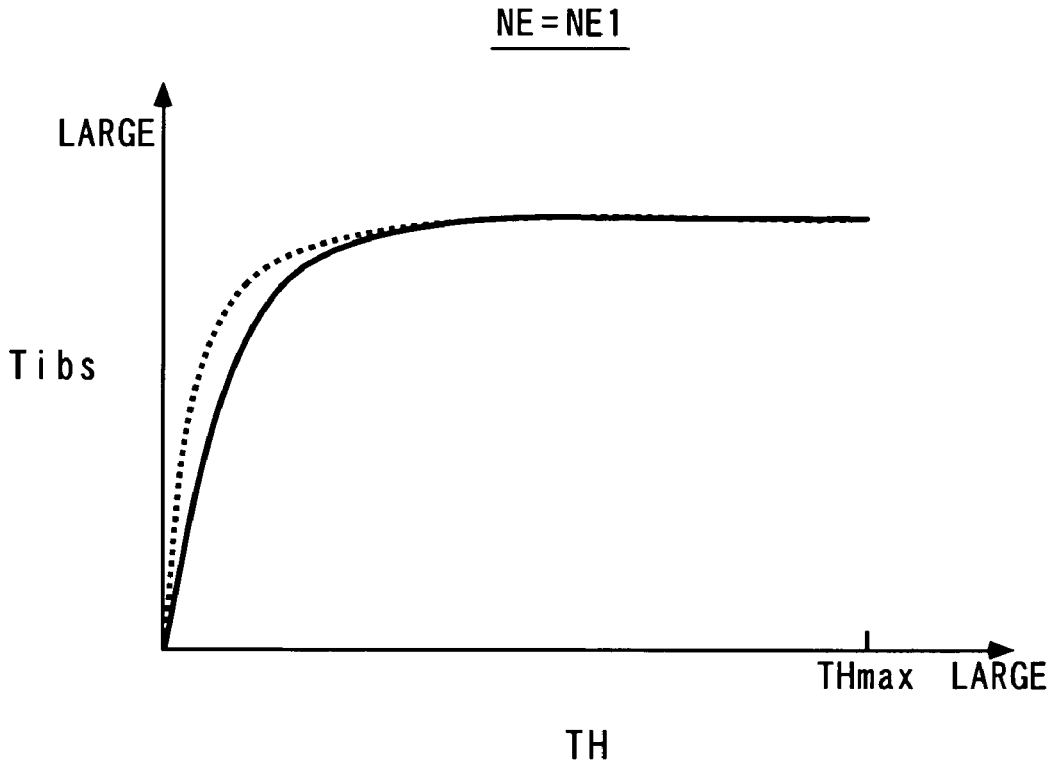
FIG. 13 is a diagram which is useful in explaining a mapping error due to temperature drift.

Next, the reason why the second fuel controller 50 calculates the second basic injection amount Tibs2 by the above-described calculation method will be described with reference to FIG. 13. In FIG. 13, a curve indicated by a solid line represents map values of the basic injection amount Tibs obtained when NE=NE1 holds in FIG. 7, and a curve indicated by a broken line represents an example in which the relationship between an appropriate value (required value) of the basic injection amount Tibs and the throttle valve opening TH deviates from the relationship between the map values and the throttle valve opening TH due to temperature drift, i.e. when a mapping error caused by the temperature drift occurs.

As described above, similarly to the case of the mapping error caused by the offset displacement, also when a mapping error caused by the temperature drift occurs, the sensor output VO2 deviates from the target output VO2_TRGT, resulting in increased exhaust emissions. Therefore, to ensure excellent reduction of exhaust emissions, it is necessary to eliminate the mapping error. In this case, since the mapping error is caused by the temperature drift, it is only required that the basic injection amount Tibs is calculated using a value obtained by decreasing or increasing the throttle valve opening TH by the amount of the temperature drift, and at the same time it is required that a value for correcting the throttle valve opening TH, i.e. the second opening correction value DTH2 is calculated according to the load on the engine 3, which has a high correlation with the throttle valve opening sensor 10. Further, the temperature drift is caused according to the load on the engine 3, and hence it occurs at different rates over a region over which the throttle valve opening TH varies from fully closed to fully open. As a consequence, mapping errors due to the temperature drift occur in a non-linear fashion in the region from the region over which the throttle valve opening TH varies from fully closed to fully open.

Therefore, the second fuel controller 50 calculates the second opening correction value DTH2 according to load on the engine 3, i.e. temperature drift by non-linearly setting the three coupling functions $\omega_i$ in a manner associated with the aforementioned three regions of the throttle valve opening TH that has a high correlation with the load on the engine, respectively, and using the three non-linear coupling functions $\omega_i$ thus set. Then, the second fuel controller 50 adds the thus calculated second opening correction value DTH2 to the throttle valve opening TH to thereby calculate the second corrected opening THmod2, and calculates the second basic injection amount Tibs2 using the second corrected opening THmod2. This makes it possible to calculate the second basic injection amount Tibs2 while quickly and properly compensating for the non-linear mapping error caused by the temperature drift.

Figure 14:
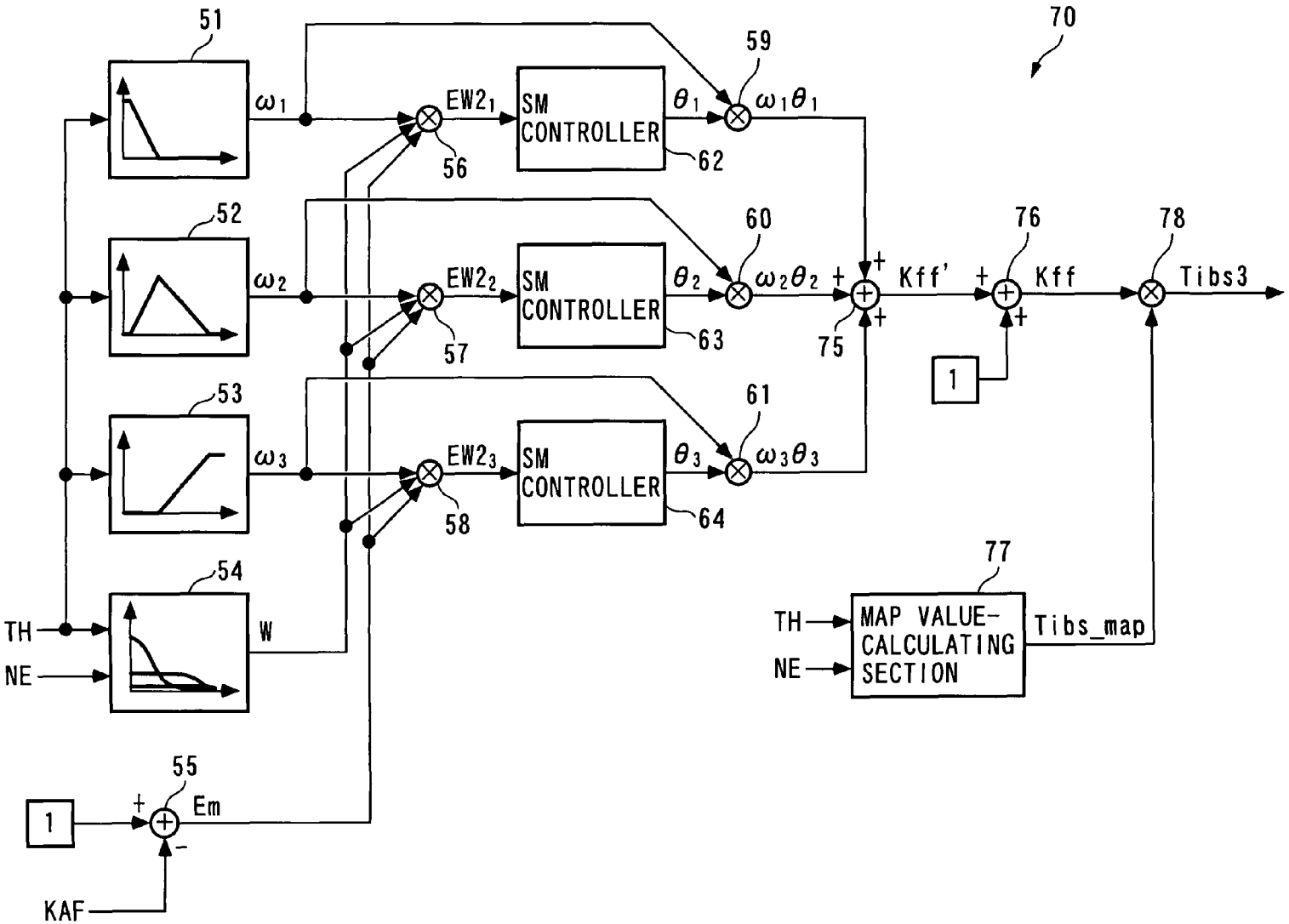
FIG. 14 is a schematic functional block diagram of a third fuel controller.

Next, the above-mentioned third fuel controller 70 will be described with reference to FIG. 14. The third fuel controller 70 calculates the third basic injection amount Tibs3 while compensating for the mapping error caused by the aforementioned sludge accumulation, by a method described hereafter. As shown in FIG. 14, the third fuel controller 70 is arranged similarly the aforementioned second fuel controller 50, except for part thereof, so that component elements of the third fuel controller 70, identical to those of the second fuel controller 50 are denoted by identical reference numerals, and detailed description thereof is omitted. Hereinafter, a description will be mainly given of points different from the second fuel controller 50.

It should be noted that in the present embodiment, the third fuel controller 70 corresponds to the feedforward input-calculating means, and the third modification value-calculating means, and the third basic injection amount Tibs3 corresponds to the feedforward input and the basic value of the fuel supply amount.

As shown in FIG. 14, the third fuel controller 70 is comprised of the three coupling function-calculating sections 51 to 53, the weight-calculating section 54, the subtractor 55, the six multipliers 56 to 61, the three SM controllers 62 to 64, two adders 75 and 76, a map value-calculating section 77, and a multiplier 78.

First, the three multipliers 59 to 61 calculate the three products $\theta_i \cdot \omega_i$ by multiplying the three modification coefficients $\theta_i$ by the three coupling functions $\omega_i$, respectively, as described hereinabove.

Then, the adder 75 calculates a product sum Kff' (total sum of a plurality of fourth products) by the following equation (21):

$$Kff'(k) = \sum_{i=1}^{3} \omega_i(k) \cdot \theta_i(k) \tag{21}$$

Further, the adder 76 calculates a correction coefficient Kff (modification value) by the following equation (22):

$$\begin{aligned} Kff(k) &= 1 + Kff'(k) \\ &= 1 + \sum_{i=1}^{3} \omega_i(k) \cdot \theta_i(k) \end{aligned} \tag{22}$$

The correction coefficient Kff is calculated by adding 1 to the product sum Kff', as described above, because the correction coefficient Kff is used as a multiplication value by which a map value Tibs_map is multiplied, and hence so as to make KFF equal to 1 when KAF≈1, i.e. VO2≈VO2_TRGT holds, which makes it unnecessary to correct the map value Tibs_map.

Figure 15:
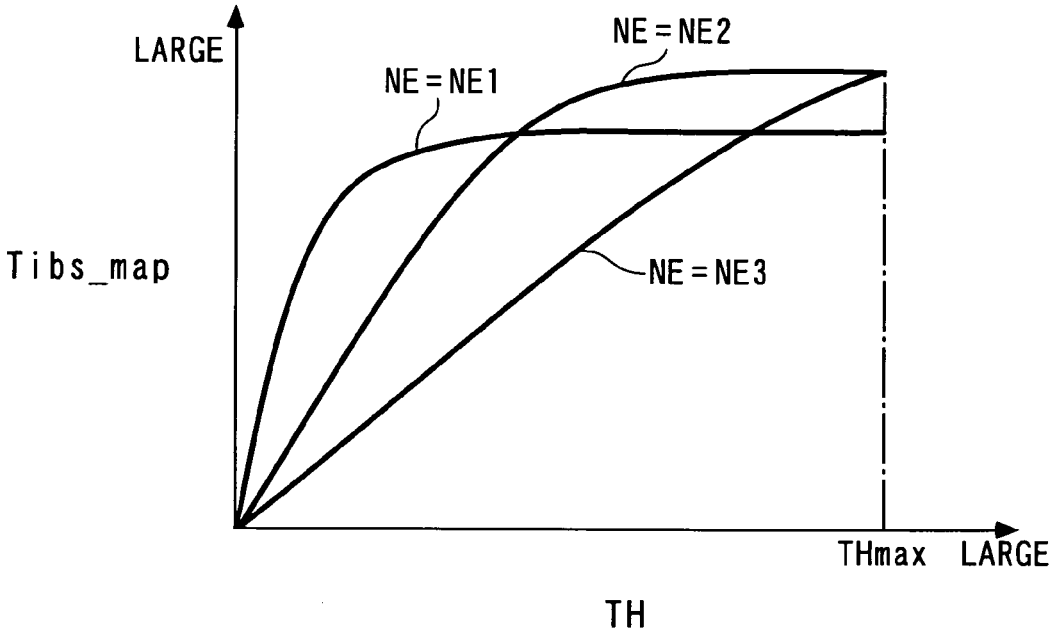
FIG. 15 is a diagram showing an example of a map for use in calculating a map value Tibs_map.

Further, the map value-calculating section 77 calculates the map value Tibs_map by searching a map shown in FIG. 15 according to the throttle valve opening TH and the engine speed NE. The map shown in FIG. 15 is formed by replacing the basic injection amount Tibs set to the vertical axis of the map shown in FIG. 7 by the map value Tibs_map. It should be noted in the present embodiment that the map value-calculating section 77 corresponds to a model value-calculating means, and the map value Tibs_map corresponds to a model value of the feedforward input.

Then, finally, the multiplier 78 (input-setting means) calculates the third basic injection amount Tibs3 by the following equation (23):

$$Tibs3(k) = Kff(k) \cdot Tibs_map(k) \tag{23}$$

Figure 16:
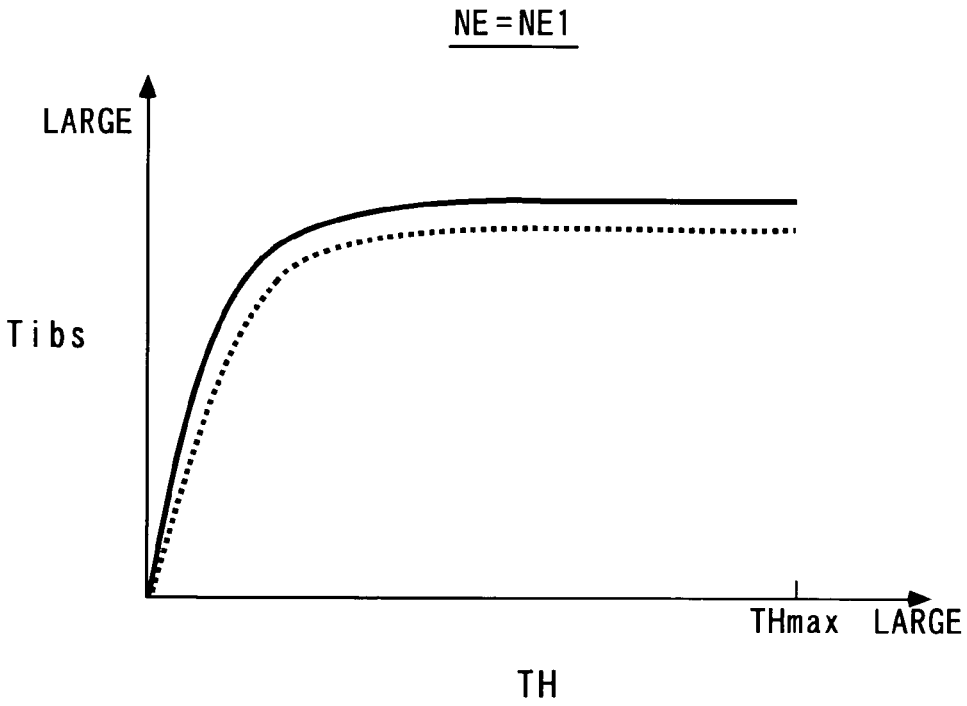
FIG. 16 is a diagram which is useful in explaining a mapping error due to sludge accumulation.

Next, the reason why the third fuel controller 70 calculates the third basic injection amount Tibs3 by the above-described calculation method will be described with reference to FIG. 16. In FIG. 16, a curve indicated by a solid line represents map values of the basic injection amount Tibs obtained when NE=NE1 holds in FIG. 7, and a curve indicated by a broken line represents an example in which the relationship between an appropriate value (required value) of the basic injection amount Tibs and the throttle valve opening TH deviates from the relationship between the map values and the throttle valve opening TH due to sludge accumulation, i.e. when a mapping error caused by the sludge accumulation occurs.

As shown in FIG. 16, when sludge accumulation has occurred, the area of the opening of the intake passage 4 is decreased to make an actual intake air amount with respect to the engine speed NE and the throttle valve opening TH lower than when no sludge accumulation has occurred. As a consequence, if the basic injection amount Tibs is calculated using the map shown in FIG. 7, the result of the calculation takes an inappropriate value, thereby causing a mapping error. In this case, since the mapping error is caused by the sludge accumulation, it is caused in a non-linear fashion with respect to a combination of the engine speed NE and the throttle valve opening TH.

As described above, also when the mapping error is caused by the sludge accumulation, the sensor output VO2 deviates from the target output VO2_TRGT, resulting in increased exhaust emissions. Therefore, to ensure excellent reduction of exhaust emissions, it is necessary to eliminate the mapping error. In this case, as described above, the mapping error due to the sludge accumulation is caused in a non-linear fashion respect to the combination of the engine speed NE and the throttle valve opening TH, and hence to compensate for the mapping error, it is necessary to non-linearly correct the relationship between the basic injection amount Tibs, and the engine speed NE and the throttle valve opening TH according to the load of the engine 3.

To this end, the third fuel controller 70 calculates the product sum Kff' by adding the above-described three products $\theta_i \cdot \omega_i$ to each other, and the correction efficient Kff is calculated by adding 1 to the product sum Kff'. Then, the third fuel controller 70 corrects the map value Tibs_map using the thus calculated correction efficient Kff to thereby calculate the third basic injection amount Tibs3. This makes it possible to calculate the third basic injection amount Tibs3 while quickly and properly compensating for the non-linear mapping error due to the sludge accumulation (i.e. linearly correcting the relationship between the basic injection amount Tibs, and the engine speed NE and the throttle valve opening TH.

Figure 17:
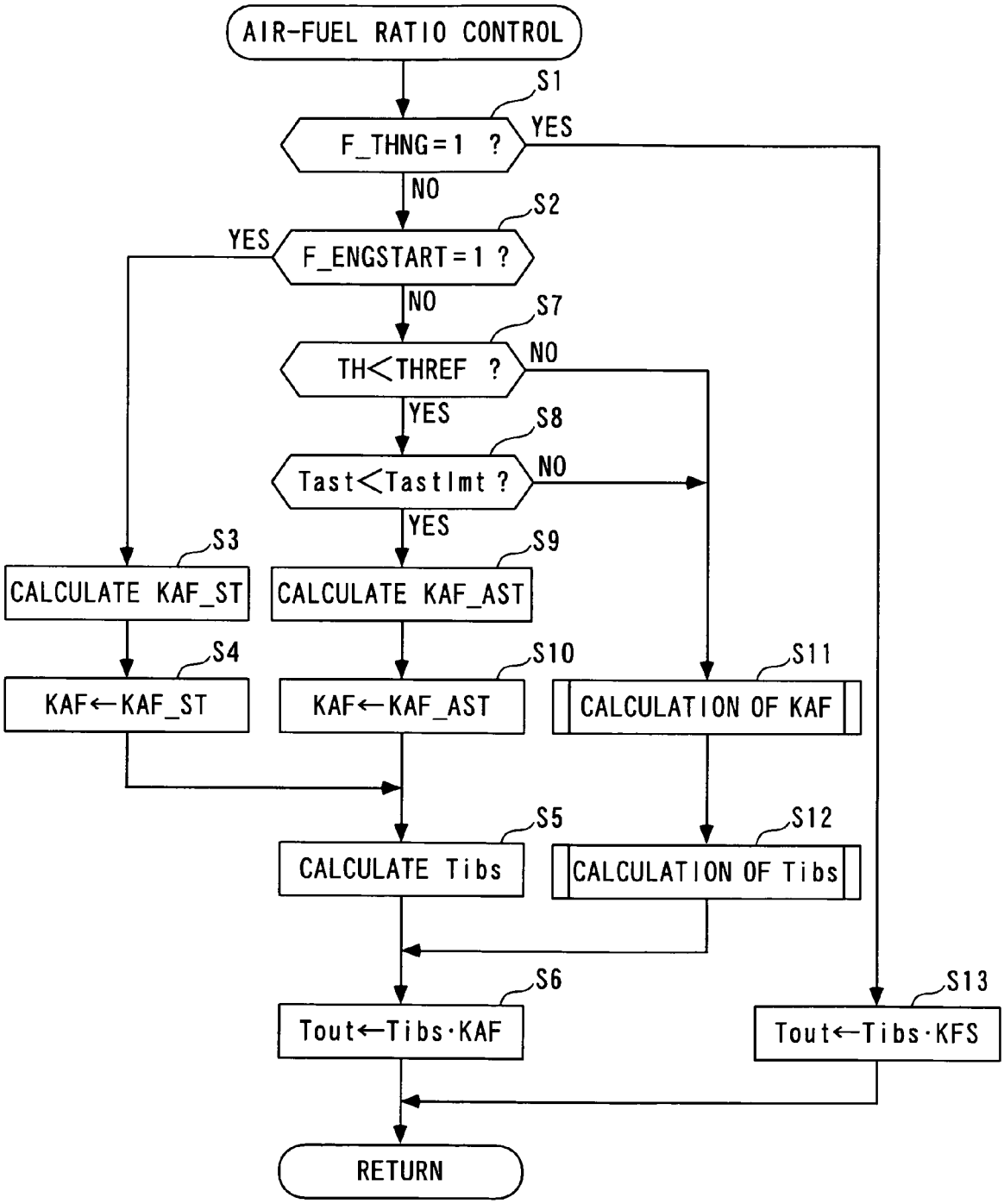
FIG. 17 is a flowchart of an air-fuel ratio control process.

Next, an air-fuel ratio control process executed by the ECU 2 will be describe with reference to FIG. 17. The present process is for calculating the fuel injection amount Tout to be injected from the fuel injection valve 6, and is executed at the aforementioned predetermined control period ΔT.

In this process, first, in a step 1 (shown as S1 in abbreviated form in FIG. 17; the following steps are also shown in abbreviated form), it is determined whether or not a TH sensor failure flag F_THNG is equal to 1. The TH sensor failure flag F_THNG is set to 1 when the throttle valve opening sensor 10 is faulty in a determination process, not shown, and otherwise set to 0.

If the answer to the question of the step 1 is negative (NO), i.e. if the throttle valve opening sensor 10 is normal, the process proceeds to a step 2, wherein it is determined whether or not an engine start flag F_ENGSTART is equal to 1. The engine start flag F_ENGSTART is set by determining in the determination process, not shown, whether or not engine start control is being executed, i.e. the engine 3 is being cranked. More specifically, when the engine start control is being executed, the engine start flag F_ENGSTART is set to 1, and otherwise set to 0.

Figure 18:
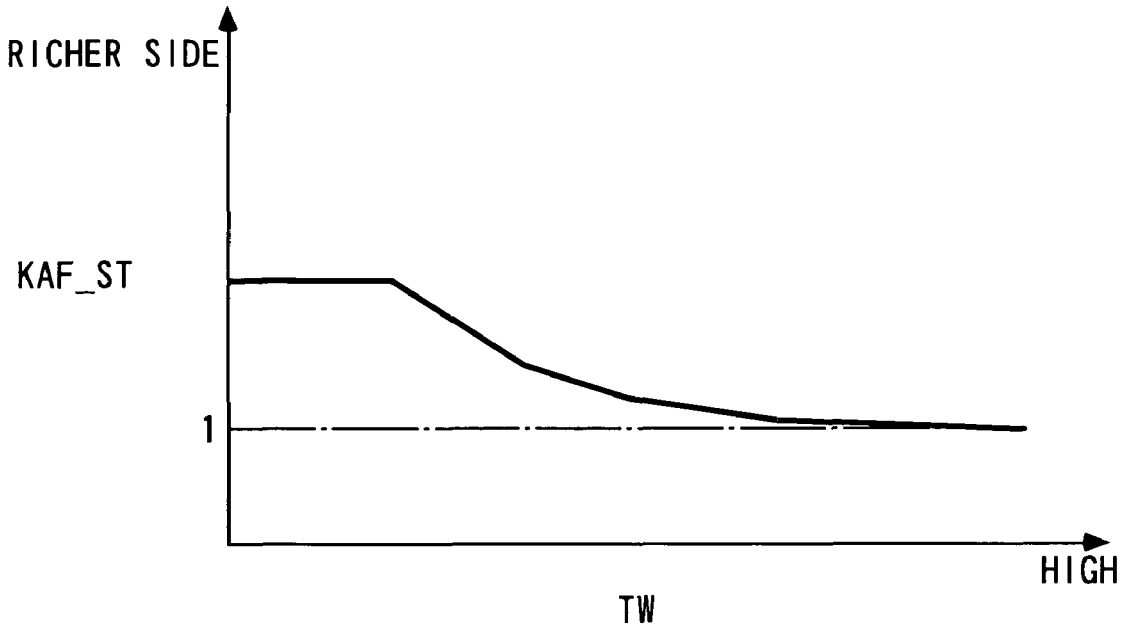
FIG. 18 is a diagram showing an example of a map for use in calculating a start-time value KAF_ST of a fuel correction coefficient.

If the answer to the question of the step 2 is affirmative (YES), i.e. if the engine start control is being executed, the process proceeds to a step 3, wherein a start-time value KAF_ST of the fuel correction coefficient is calculated by searching a map shown in FIG. 18 according to engine coolant temperature TW. In this map, the start-time value KAF_ST is set to a richer value as the engine coolant temperature TW is lower. This is because when the engine coolant temperature TW is low, to enhance the startability of the engine 3, it is required to control the mixture to a richer value.

Next, the process proceeds to a step 4, the fuel correction coefficient KAF is set to the above-described start-time value KAF_ST. In a step 5 following the step 4, the basic injection amount Tibs is calculated by searching the aforementioned map shown in FIG. 7 according to the engine speed NE and the throttle valve opening TH.

Then, the process proceeds to a step 6, the fuel injection amount Tout is set to a product Tibs KAF of the basic injection amount Tibs and the fuel correction coefficient KAF, followed by terminating the present process.

On the other hand, if the answer to the question of the step 2 is negative (NO), i.e. if the engine start control is not being executed, the process proceeds to a step 7, wherein it is determined whether or not the throttle valve opening TH is smaller than a predetermined value THREF. If the answer to this question is affirmative (YES), i.e. if the driver is not operating the throttle lever, the process proceeds to a step 8, wherein it is determined whether or not the count Tast of an after-start timer is smaller than a predetermined value Tastlmt.

Figure 19:
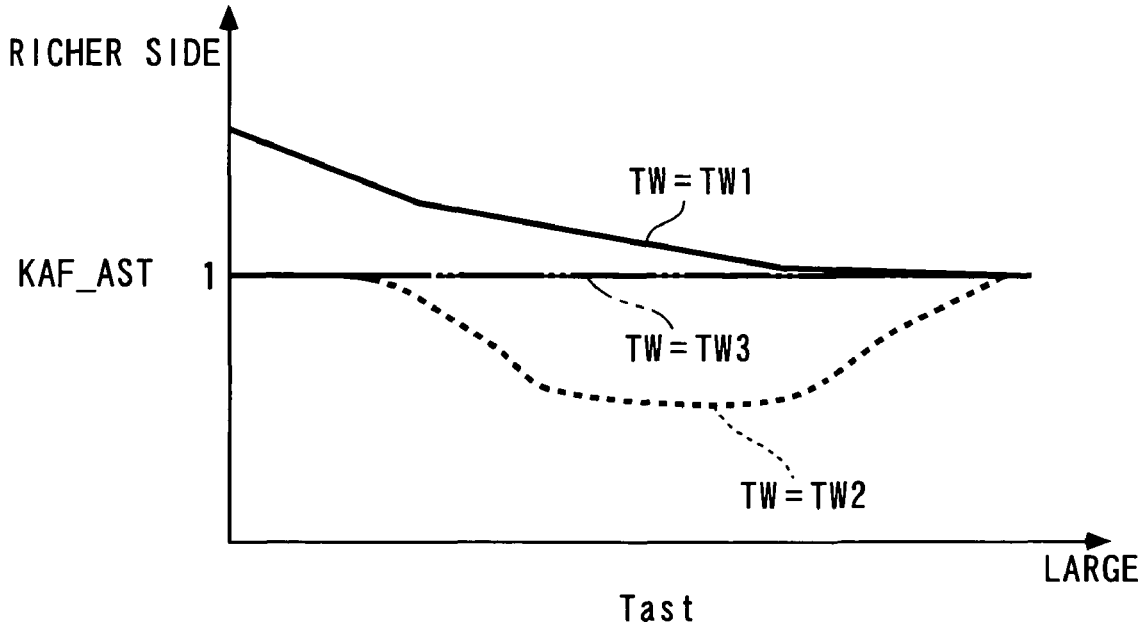
FIG. 19 is a diagram showing an example of a map for use in calculating a catalyst warmup value KAF_AST of the fuel correction coefficient.

If the answer to this question is affirmative (YES), i.e. if Tast<Tastlmt holds, it is judged that the catalyst warmup control should be executed, and the process proceeds to a step 9, wherein a catalyst warmup value KAF_AST of the fuel correction coefficient is calculated by searching a map shown in FIG. 19 according to the count Tast of the after-start timer and the engine coolant temperature TW. In FIG. 19, TW1 to TW3 represent predetermined values of the engine coolant temperature TW, which satisfy the relationship of TW1<TW2<TW3.

In this map, in a low temperature region of the engine coolant where TW=TW1 is caused to hold, the catalyst warmup value KAF_AST is set to a larger value on the richer side as the count Tast is smaller, so as to accelerate activation of the catalysts. Further, in a high temperature region of the engine coolant where TW=TW3 is caused to hold, and the catalyst warmup control has been completed, the catalyst warmup value KAF_AST is set to a value corresponding to the stoichiometric air-fuel ratio.

Next, the process proceeds to a step 10, wherein the fuel correction coefficient KAF is set to the catalyst warmup value KAF_AST. After that, as described hereinabove, the steps 5 and 6 are executed, followed by terminating the present process.

On the other hand, if the answer to the question of the step 7 or 8 is negative (NO), i.e. if the accelerator pedal is stepped on, or if Tast≧Tastlmt holds, the process proceeds to a step 11, wherein the fuel correction coefficient KAF is calculated by the calculation method by the aforementioned fuel correction coefficient-calculating section 20.

Figure 20:
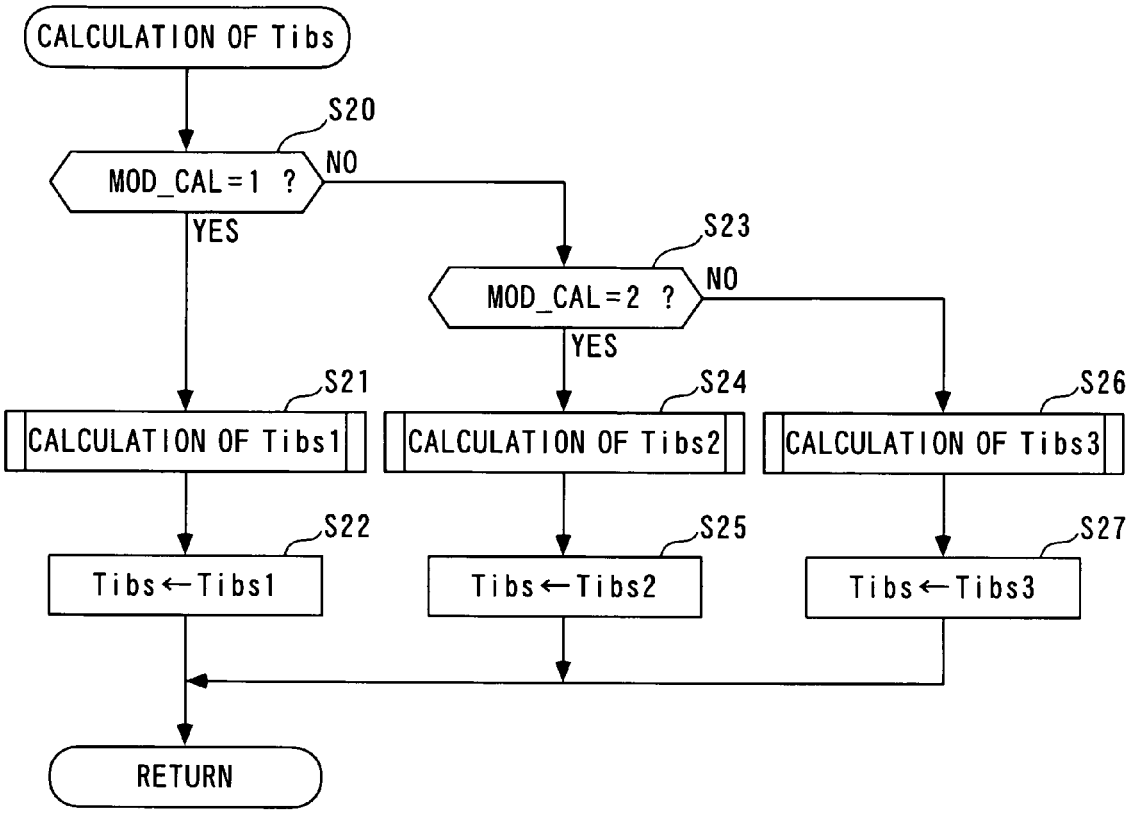
FIG. 20 is a flowchart of a process for calculating the basic injection amount Tibs.

Then, the process proceeds to a step 12, wherein the basic injection amount Tibs is calculated. The calculation process in the step 12 is specifically executed as shown in FIG. 20. More specifically, first, in a step 20, it is determined whether or not the aforementioned calculation mode value MOD_CAL is equal to 1.

If the answer to this question is affirmative (YES), i.e. if it is judged that the mapping error caused by the offset displacement should be compensated for, the process proceeds to a step 21, wherein the first basic injection amount Tibs1 is calculated by the calculation method by the aforementioned first fuel controller 40. Then, in a step 22, the basic injection amount Tibs is set to the first basic injection amount Tibs1, followed by terminating the present process.

On the other hand, if the answer to the question of the step 20 is negative (NO), the process proceeds to a step 23, wherein it is determined whether or not the calculation mode value MOD_CAL is equal to 2. If the answer to this question is affirmative (YES), i.e. if it is judged that the mapping error caused by the temperature drift should be compensated for, the process proceeds to a step 24, wherein the second basic injection amount Tibs2 is calculated by the calculation method by the aforementioned second fuel controller 50. Then, in a step 25, the basic injection amount Tibs is set to the second basic injection amount Tibs2, followed by terminating the present process.

On the other hand, if the answer to the question of the step 23 is negative (NO), i.e. if it is judged that the mapping error caused by the sludge accumulation should be compensated for, the process proceeds to a step 26, wherein the third basic injection amount Tibs3 is calculated by the calculation method by the aforementioned third fuel controller 70. Then, in a step 27, the basic injection amount Tibs is set to the third basic injection amount Tibs3, followed by terminating the present process.

Referring again to FIG. 17, after the basic injection amount Tibs is calculated as described above in the step 12, the fuel injection amount Tout is calculated in the step 6, as described above, followed by terminating the present process.

On the other hand, if the answer to the question of the step 1 is affirmative (YES), i.e. if the throttle valve opening sensor 10 is faulty, the process proceeds to a step 13, wherein the fuel injection amount Tout is set to the product Tibs·KFS of the basic injection amount Tibs and a predetermined failure time value KFS of the fuel correction coefficient, followed by terminating the present process. The failure time value KFS is set such that the air-fuel ratio of the mixture takes a richer value, so as to stabilize the combustion state of the mixture.

The control apparatus 1 according to the present embodiment calculates the fuel injection amount Tout by the above-described air-fuel ratio control process, and although not shown, calculates fuel injection timing according to the fuel injection amount Tout and the engine speed NE. Further, the control apparatus 1 drives the fuel injection valve 6 by a control input signal generated based on the fuel injection amount Tout and the fuel injection timing, to thereby control the air-fuel ratio of the mixture.

Next, results of simulations (hereinafter referred to as the "control results") of the air-fuel ratio control carried out by the control apparatus 1 according to the present embodiment will be described with reference to FIGS. 21A to 21F to FIGS.

26A to 26E. FIGS. 21A to 21F to FIGS. 26A to 26E each show the control results obtained when the load on the engine 3, i.e. the engine speed NE and the throttle valve opening TH as the operating conditions of the engine 3 are set such they are periodically increased and decreased.

First, a description will be given of the control results shown in FIGS. 21A to 21F and FIGS. 22A to 22E. FIGS. 21A to 21F show an example of the control results obtained by the control apparatus 1 according to the present embodiment. More specifically, FIGS. 21A to 21F show an example of results of a simulation of air-fuel ratio control, which is performed by setting simulation conditions to those of a state in which the mapping error is caused by offset displacement, and using the first basic injection amount Tibs1 calculated by the first fuel controller 40 as the basic injection amount Tibs. For comparison, FIGS. 22A to 22E show an example of the control results (hereinafter referred to as the "comparative example 1") obtained by setting the same simulation conditions as set in FIGS. 21A to 21F, and using the basic injection amount Tibs calculated by using the map shown in FIG. 7.

Figures 21A, 21B, 21C, 21D, 21E, 21F:
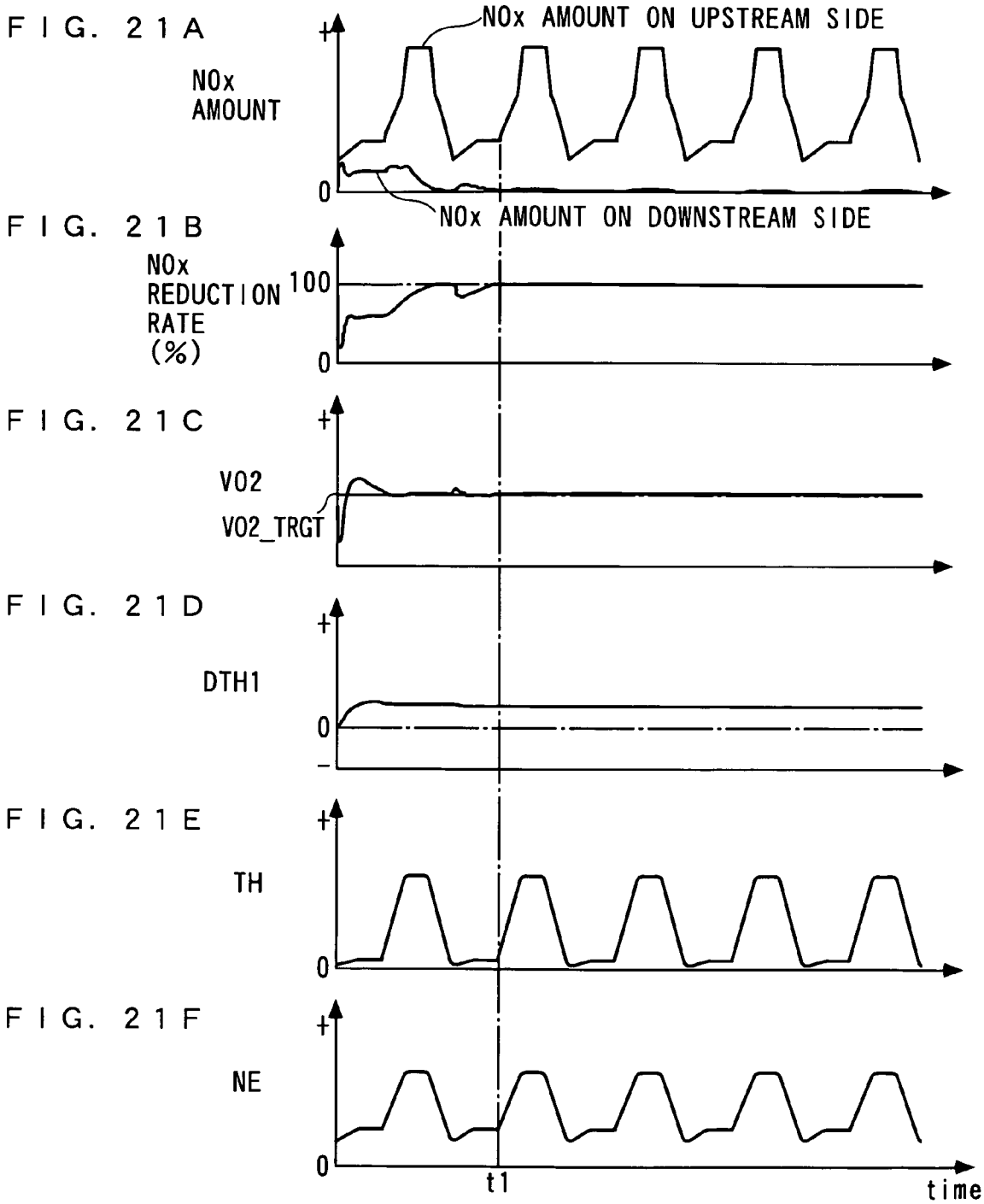
FIGS. 21A to 21F are a timing diagram showing an example of results of a simulation of air-fuel ratio control, which is performed by setting a state in which the mapping error is caused by the offset displacement to a simulation condition, and using the first basic injection amount Tibs1 as the basic injection amount Tibs.

In a timing diagram appearing in FIG. 21A, an upper curve indicates the NOx amount on the upstream side of the first catalytic device 8. Further, a timing diagram appearing in FIG. 21B shows the NOx reduction rate of the first catalytic device 8. These relationships also apply to FIGS. 22A to 22E to FIGS. 26A to 26E.

Figures 22A, 22B, 22C, 22D, 22E:
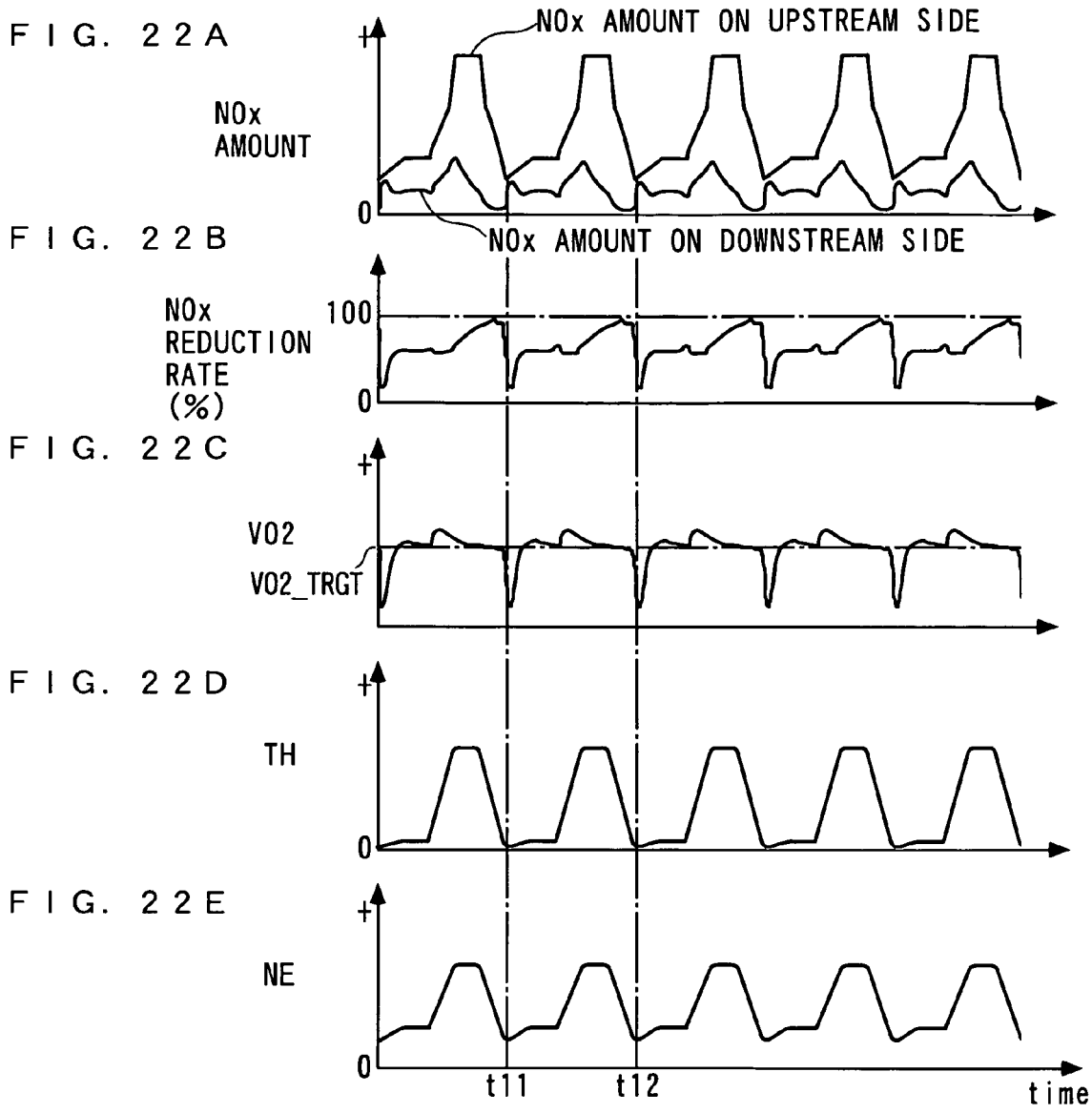
FIGS. 22A to 22E are a timing diagram showing an example of results of a simulation of air-fuel ratio control, which is performed, for comparison, under the same simulation condition as in FIGS. 21A to 21F, and by calculating the basic injection amount Tibs using the map shown in FIG. 7.

First, in the comparative example 1 in FIGS. 22A to 22E, as shown in FIG. 22C, the sensor output VO2 largely deviates from the target output VO2_TRGT periodically due to the mapping error (time points t11, t12, etc.). As a consequence, it is understood that the NOx reduction rate of the first catalytic device 8 becomes markedly lower periodically, as shown in FIG. 22B.

In contrast, from the example of the control results shown in FIGS. 21A to 21F, it is understood that although immediately after the start of the control, as shown in FIG. 21C, the sensor output VO2 slightly deviates from the target output VO2_TRGT temporarily due to the mapping error, the sensor output VO2 converges to the target output VO2_TRGT after a time point t1 as the control proceeds, whereby as shown in FIG. 22B, it is possible to ensure an excellent NOx reduction rate. This is because the first opening correction value DTH1 converges to its optimum value after the time point t1 (see FIG. 21D), whereby the first basic injection amount Tibs1 converges to an appropriate value. As described above, it is understood that the mapping error due to the offset displacement can be properly compensated for by the control method by the first fuel controller 40 according to the present embodiment.

Next, a description will be given of the control results shown in FIGS. 23A to 23I and FIGS. 24A to 24E. FIGS. 23A to 23I show an example of the control results obtained by the control apparatus 1 according to the present embodiment. More specifically, FIGS. 23A to 23I show an example of results of a simulation of air-fuel ratio control, which is performed by setting simulation conditions to those of a state in which the mapping error is caused by the temperature drift, and using the second basic injection amount Tibs2 calculated by the second fuel controller 50 as the basic injection amount Tibs. For comparison, FIGS. 24A to 24E show an example of the control results (hereinafter referred to as the "comparative example 2") obtained by setting the same simulation conditions as set in FIGS. 23A to 23I, and using the basic injection amount Tibs calculated by using the map shown in FIG. 7.

Figures 24A, 24B, 24C, 24D, 24E:
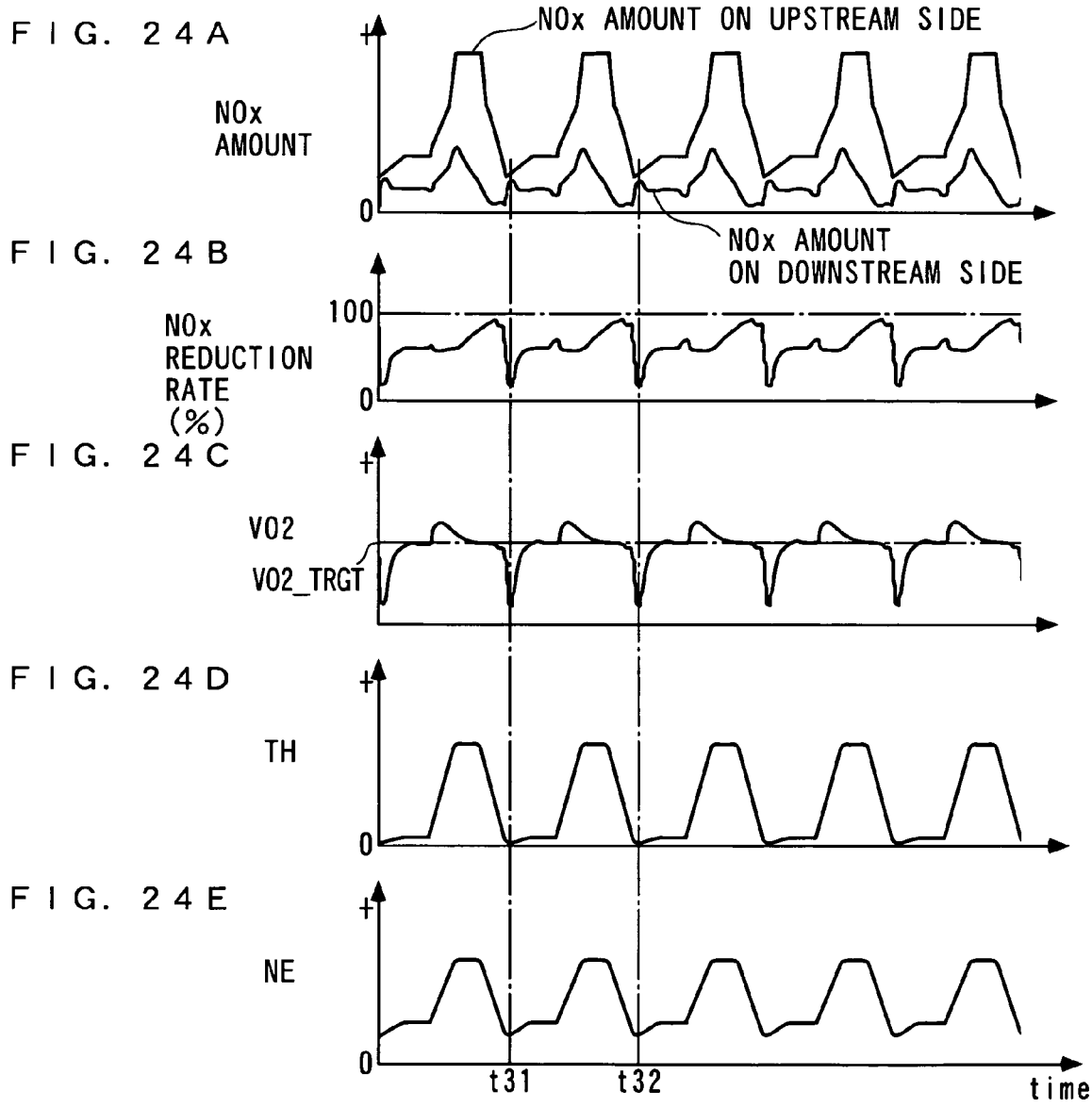
FIGS. 24A to 24E are a timing diagram showing an example of results of a simulation of air-fuel ratio control, which is performed, for comparison, under the same simulation condition as in FIGS. 23A to 23I, by calculating the basic injection amount Tibs using the map shown in FIG. 7.

First, in the comparative example 2 in FIGS. 24A to 24E, as shown in FIG. 24C, the sensor output VO2 largely deviates from the target output VO2_TRGT periodically due to the mapping error (time points t31, t32, etc.). As a consequence, it is understood that the NOx reduction rate of the first catalytic device 8 becomes markedly lower periodically, as shown in FIG. 24B.

Figures 23A, 23B, 23C, 23D, 23E, 23F, 23G, 23H, 23I:
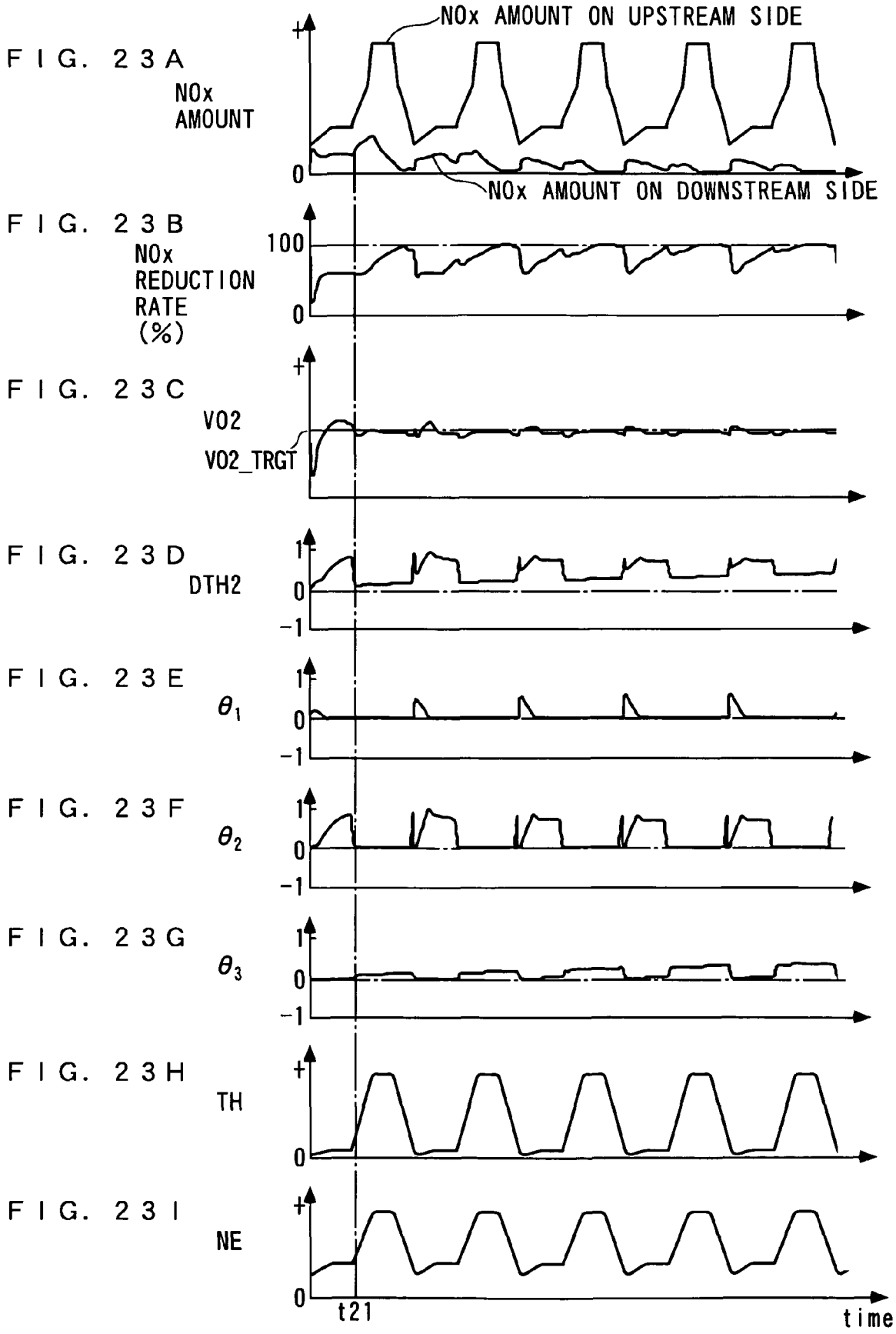
FIGS. 23A to 23I are a timing diagram showing an example of results of a simulation of air-fuel ratio control, which is performed by setting a state in which the mapping error is caused by the temperature drift to a simulation condition, and using the second basic injection amount Tibs2 as the basic injection amount Tibs.

In contrast, from the example of the control results shown in FIGS. 23A to 23I, it is understood that although immediately after the start of the control, as shown in FIG. 23C, the sensor output VO2 slightly deviates from the target output VO2_TRGT temporarily due to the mapping error, the sensor output VO2 almost converges to the target output VO2_TRGT after a time point t21 as the control proceeds, whereby it is possible to ensure a more excellent NOx reduction rate than in the comparative example 2. In addition, it is understood that the NOx reduction rate is progressively enhanced as the control proceeds. This is because the learning of the second opening correction value DTH2 proceeds as the control proceeds (see FIG. 23D), whereby the accuracy of the calculation of the second basic injection amount Tibs2 is improved. As described above, it is understood that a non-linear mapping error due to the temperature drift can be properly compensated for by the control method by the second fuel controller 50 according to the present embodiment.

Next, a description will be given of the control results shown in FIGS. 25A to 25I and FIGS. 26A to 26E. FIGS. 25A to 25I show an example of the control results obtained by the control apparatus 1 according to the present embodiment. More specifically, FIGS. 25A to 25I show an example of results of a simulation of air-fuel ratio control, which is performed by setting simulation conditions to those of a state in which the mapping error is caused by the sludge accumulation, and using the third basic injection amount Tibs3 calculated by the third fuel controller 70 as the basic injection amount Tibs. For comparison, FIGS. 26A to 26E show an example of the control results (hereinafter referred to as the "comparative example 3") obtained by setting the same simulation conditions as set in FIGS. 25A to 25I, and using the basic injection amount Tibs calculated by using the map shown in FIG. 7.

Figures 26A, 26B, 26C, 26D, 26E:
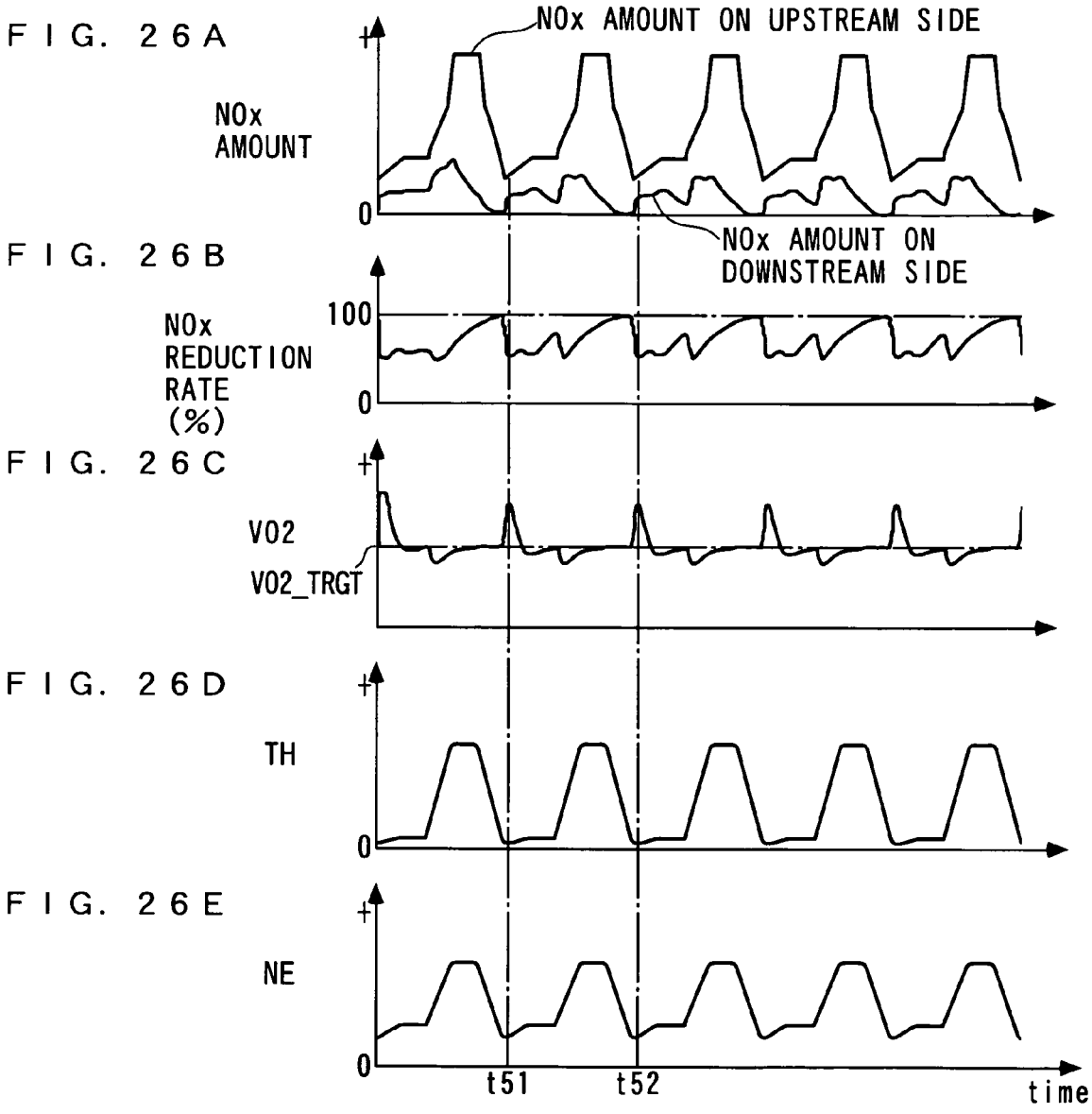
FIGS. 26A to 26E are a timing diagram showing an example of results of a simulation of air-fuel ratio control, which is performed, for comparison, under the same simulation condition as in FIGS. 25A to 25I, by calculating the basic injection amount Tibs using the map shown in FIG. 7.

First, in the comparative example 3 in FIGS. 26A to 26E, as shown in FIG. 26C, the sensor output VO2 largely deviates from the target output VO2_TRGT periodically due to the mapping error (time points t51, t52, etc.). As a consequence, it is understood that the NOx reduction rate of the first catalytic device 8 becomes markedly lower periodically, as shown in FIG. 26B.

Figures 25A, 25B, 25C, 25D, 25E, 25F, 25G, 25H, 25I:
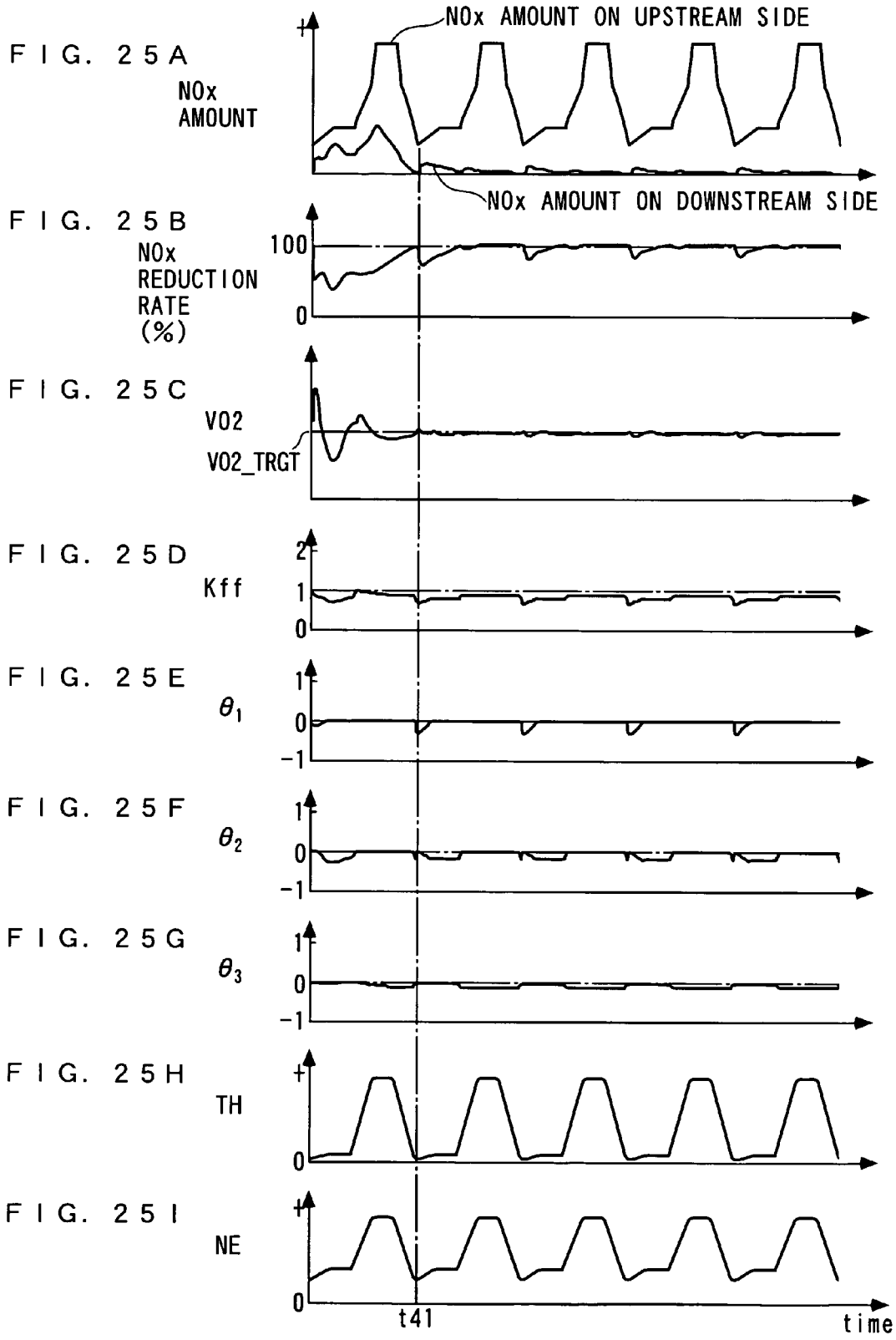
FIGS. 25A to 25I are a timing diagram showing an example of results of a simulation of air-fuel ratio control, which is performed by setting a state in which the mapping error is caused by the sludge accumulation to a simulation condition, and using the third basic injection amount Tibs3 as the basic injection amount Tibs.

In contrast, from the example of the control results shown in FIGS. 25A to 25I, it is understood that although immediately after the start of the control, as shown in FIG. 25C, the sensor output VO2 temporarily deviates from the target output VO2_TRGT due to the mapping error, the sensor output VO2 almost converges to the target output VO2_TRGT after a time point t41 as the control proceeds, whereby it is possible to ensure a more excellent NOx reduction rate than in the comparative example 3. In addition, it is understood that the NOx reduction rate is progressively enhanced as the control proceeds. This is because the earning of the correction coefficient Kff proceeds as the control proceeds (see FIG. 25D), whereby the accuracy of the calculation of the third basic injection amount Tibs3 is improved. As described above, it is understood that the non-linear mapping error due to the sludge accumulation can be properly compensated for by the control method by the third fuel controller 70 according to the present embodiment.

As described hereinabove, according to the control apparatus 1 of the present embodiment, one of the three values Tibs1 to Tibs3 calculated by the first to third fuel controllers 40, 50, and 70 is set as the basic injection amount Tibs depending on the type of a mapping error which is liable to be caused in the engine 3, and the set value is multiplied by the fuel correction coefficient KAF, to thereby calculate the fuel injection amount Tout.

More specifically, when MOD_CAL=1 holds, and hence a mapping error caused by offset displacement is liable to occur, the first basic injection amount Tibs1 calculated by the first fuel controller 40 is set as the basic injection amount Tibs. The first fuel controller 40 calculates the first opening correction value DTH1 with the sliding mode control algorithm such that the correction modeling error Ew converges to 0. In this case, the correction modeling error Ew is obtained by multiplying the modeling error Em by the weight W, and the modeling error Em is the difference between 1 and the fuel injection amount KAF, and hence the first opening correction value DTH1 is calculated such that KAF≈1, i.e. VO2≈VO2_TRGT holds. Further, the weight W by which the modeling error Em is multiplied represents the sensitivity of the basic injection amount Tibs to the throttle valve opening TH, and the probability of the offset displacement causing the modeling error Em becomes higher as the weight W is larger. Therefore, by using such a weight, it is possible to calculate the first opening correction value DTH1 while causing whether the probability of the offset displacement causing the modeling error Em is higher or lower to be reflected on the first opening correction value DTH1.

Furthermore, the first basic injection amount Tibs1 is calculated by searching the FIG. 6 map according to the first corrected opening THmod1, which is obtained by correcting the throttle valve opening TH using the first opening correction value DTH1 calculated as above, and the engine speed NE, so that the first basic injection amount Tibs1 is calculated such that KAF≈1, i.e. VO2≈VO2_TRGT holds. As a consequence, even when the engine 3 is in transient operating conditions in the case of occurrence of a mapping error caused by offset displacement, it is possible to accurately calculate the first basic injection amount Tibs1 while quickly and properly compensating for the mapping error.

Further, when MOD_CAL=2 holds, and hence a mapping error caused by the temperature drift is liable to occur, the second basic injection amount Tibs2 calculated by the second fuel controller 50 is set as the basic injection amount Tibs. The second fuel controller 50 calculates the three second correction modeling errors $Ew2_i$ by multiplying the three non-linear coupling functions $\omega_i$ by the product of the modeling error Em and the weight W, and calculates the three modification coefficients $\theta_i$ such that the three second correction modeling errors $Ew2_i$ converge to 0, which makes it possible to distribute the modeling error Em to the three modification coefficients $\theta_i$ via the three coupling functions $\omega_i$. Furthermore, the three products $\theta_i \cdot \omega_i$ are calculated by multiplying the three coupling functions $\omega_i$ by the three modification coefficients $\theta_i$ obtained as above, respectively, and the second opening correction value DTH2 is calculated as the sum of the three products $\theta_i \cdot \omega_i$. This makes it possible to properly compensate for the mapping error in each of the three regions of the throttle valve opening TH by the second opening correction value DTH2. Particularly when the direction of occurrence of a mapping error is different between the three regions of the throttle valve opening TH, i.e. even when a non-linear mapping error is caused, it is possible to properly compensate for the mapping error on a region-by-region basis.

In addition, the three products $\theta_i \cdot \omega_i$ are calculated by multiplying the three coupling functions $\omega_i$ by the three modification coefficients $\theta_i$, respectively, and hence it is possible to calculate the second opening correction value DTH2, which is the total sum of the three products $\theta_i \cdot \omega_i$, as a value obtained by continuously coupling the three modification coefficients $\theta_i$. Therefore, by correcting the throttle valve opening TH using the thus calculated second opening correction value DTH2 to calculate the second corrected opening THmod2, and calculating the second basic injection amount Tibs2 using the second corrected opening THmod2, it is possible to calculate the second basic injection amount Tibs2 smoothly and steplessly even when the throttle valve opening TH is suddenly changed. As described above, even when the engine 3 is in transient operating conditions in the case of occurrence of a mapping error caused by the temperature drift, it is possible to accurately calculate the second basic injection amount Tibs2 while quickly and properly compensating for the mapping error.

Further, when MOD_CAL=3 holds, and hence a mapping error caused by the sludge accumulation is liable to occur, the third basic injection amount Tibs3 calculated by the third fuel controller 70 is set as the basic injection amount Tibs. The third fuel controller 70 calculates the three second correction modeling errors $Ew2_i$ by multiplying the three non-linear coupling functions $\omega_i$ by the product of the modeling error Em and the weight W, and calculates the three modification coefficients $\theta_i$ such that the three second correction modeling errors $Ew2_i$ converge to 0. Therefore, as described above, it is possible to distribute the modeling error Em to the three modification coefficients $\theta_i$ via the three coupling functions $\omega_i$. Furthermore, the three products $\theta_i \cdot \omega_i$ are calculated by multiplying the three coupling functions $\omega_i$ by the three modification coefficients $\theta_i$ obtained as above, respectively, and the product sum Kff' is calculated by adding the above-described three products $\theta_i \cdot \omega_i$ to each other. Then, the correction efficient Kff is calculated by adding 1 to the product sum Kff'. This makes it possible to properly compensate for the mapping error in each of the three regions of the throttle valve opening TH by the correction efficient Kff. Particularly when the relationship between the engine speed NE and the throttle valve opening TH, and the map value Tibs_map deviates from the actual relationship therebetween, if the direction of the deviation is different between the three regions of the throttle valve opening TH, i.e. even if a non-linear mapping error is caused, it is possible to properly compensate for the mapping error on a region-by-region basis.

In addition, since the three products $\theta_i \cdot \omega_i$ are calculated by multiplying the three coupling functions $\omega_i$ by the three modification coefficients $\theta_i$, respectively, it is possible to calculate the product sum Kff', which is the total sum of the three products $\theta_i \cdot \omega_i$, as a value obtained by continuously coupling the three modification coefficients $\theta_i$. Further, the third basic injection amount Tibs3 is calculated by correcting the map value Tibs_map of the basic injection amount using the correction efficient Kff obtained by adding 1 to the product sum Kff' calculated as above. Therefore, even when the throttle valve opening TH is suddenly changed, it is possible to calculate the third basic injection amount Tibs3 smoothly and steplessly. As a consequence, even when the engine 3 is in transient operating conditions in the case of occurrence of a mapping error caused by the sludge accumulation, it is possible to accurately calculate the third basic injection amount Tibs3 while quickly and properly compensating for the mapping error.

As described above, in the case of occurrence of any of the three mapping errors, which are caused by the offset displacement, the temperature drift, and the sludge accumulation, respectively, even when the engine 3 is in transient operating conditions, it is possible to accurately calculate the basic injection amount Tibs while quickly and properly compensating for the mapping error. As a consequence, even when the engine 3 is in transient operating conditions, it is possible to hold the sensor output VO2 at the target output VO2_TRGT to ensure excellent reduction of exhaust emissions.

It should be noted that although in the present embodiment, the control apparatus 1 according to the present invention is applied to the controlled object in which the output VO2 of the oxygen concentration sensor 12 is a controlled variable and the fuel injection amount Tout is a control input, by way of example, this is not limitative, but it may be applied to any suitable controlled object in various industrial apparatuses in which an output therefrom is a controlled variable and an input thereto is a control input.

Further, although in the present embodiment, the sliding mode control algorithm is employed as a predetermined feedback control algorithm, by way of example, the predetermined feedback control algorithm according to the present invention is not limited to this, but any suitable feedback control algorithm may be used insofar as it is capable of feedback-controlling a controlled variable such that the controlled variable is caused to converge to a target controlled variable. For example, as the feedback control algorithm according to the present invention, there may be used any of a PID control algorithm, a back-stepping control algorithm, a response-specifying control algorithm in which a controlled object model of a sliding mode control algorithm is replaced by a controlled object model of a linear type, or an optimum regulation algorithm.

Further, although in the present embodiment, a sliding mode control algorithm is used as a predetermined control algorithm, by way of example, the predetermined control algorithm according to the present invention is not limited to this, but any suitable control algorithm may be used insofar as it is capable of calculating a modification value for making a feedback correction value equal to a predetermined target value. For example, as the predetermined control algorithm according to the present invention, there may be used any of a PID control algorithm, a back-stepping control algorithm, a response-specifying control algorithm in which a controlled object model of a sliding mode control algorithm is replaced by a controlled object model of a linear type, or an optimum regulation algorithm.

On the other hand, although in the present embodiment, the fuel injection amount Tout as the control input is calculated by correcting the basic injection amount Tibs as the feedforward input by the fuel correction coefficient KAF as the feedback correction value, by way of example, the method of calculating the control input according to the present invention is not limited to this, but any suitable method of calculating the control input may be used insofar as it is capable of calculating the control input based on a value obtained by correcting the feedforward input by the feedback correction value. For example, in the present embodiment, the fuel injection amount Tout may be calculated by adding or subtracting the fuel injection amount Tout to or from the product of the basic injection amount Tibs and the fuel correction coefficient KAF, or multiplying the product of the basic injection amount Tibs and the fuel correction coefficient KAF by the fuel injection amount Tout.

Further, although in the present embodiment, the throttle valve opening TH and the engine speed NE are each used as the first operational state parameter and the operational state parameter, by way of example, the first operational state parameter and the operational state parameter according to the present invention are not limited to these, but any suitable first operational state parameter and operational state parameter may be used insofar as they represent operational states of a controlled object other than the controlled variable. For example, when the engine is provided with an accelerator pedal, the operation amount of the accelerator pedal may be used as the first operational state parameter and the operational state parameter, and when the engine is provided with a variable lift mechanism for steplessly and continuously changing the lift of at least one of an intake valve and an exhaust valve thereof, the lift may be used as the first operational state parameter and the operational state parameter. Further, the number of the operational state parameters used for searching maps is not limited to two, but three or more operational state parameters may be used.

Further, although in the present embodiment, the throttle valve opening TH and the engine speed NE are used as the operating condition parameters, by way of example, the operating condition parameters according to the present invention are not limited to these, but any suitable operating condition parameter may be used insofar as it represents an operating condition of the engine. For example, when the engine is provided with an accelerator pedal, the operation amount of the accelerator pedal may be used as the operating condition parameter, and when the engine is provided with a variable lift mechanism for steplessly and continuously changing the lift of at least one of an intake valve and an exhaust valve thereof, the lift may be used as an operating condition parameter.

Further, although in the present embodiment, the throttle valve opening TH is used as the second and third operational state parameters, by way of example, the second and third operational state parameters according to the present invention are not limited to this, but any suitable second and third operational state parameters may be used insofar as they represent an operational state of a controlled object. For example, the engine speed NE may be used as the second and third operational state parameters. Furthermore, when the engine is provided with a variable lift mechanism for steplessly and continuously changing the lift of at least one of an intake valve and an exhaust valve thereof, the lift may be used as second and third operational state parameters.

On the other hand, although in the present embodiment, the weight W is used as the first to third sensitivity parameters, by way of example, the first to third sensitivity parameters according to the present invention are not limited to this, but any suitable first to third sensitivity parameters may be used insofar as they represent the sensitivity of a feedforward input to the first operational state parameter. For example, a ratio between the feedforward input and the first operational state parameter may be used as the first to third sensitivity parameters.

Further, although in the present embodiment, the oxygen concentration sensor 12 is used as the exhaust gas concentration sensor, by way of example, the exhaust gas concentration sensor according to the present invention is not limited to this, but any suitable exhaust gas concentration sensor may be used insofar as it detects the concentration of a predetermined component of exhaust gases. For example, an NOx concentration sensor for detecting the concentration of NOx in exhaust gases may be used as the exhaust gas concentration sensor.

Furthermore, although in the present embodiment, the control apparatus according to the present invention is applied to the internal combustion engine for a motorcycle, by way of example, this is not limitative, but the control apparatus according to the present invention may be applied to an internal combustion engine with a relatively small displacement e.g. one for a light car.

On the other hand, although in the present embodiment, the calculation mode value MOD_CAL is configured such that it is not changed after it is set in advance at the time of shipment from a factory, by way of example, this is not limitative, but the calculation mode value MOD_CAL may be configured such that it can be changed, as required, e.g. via a manual switch.

It is further understood by those skilled in the art that the foregoing are preferred embodiments of the invention, and that various changes and modifications may be made without departing from the spirit and scope thereof.

We claim:

1. A control apparatus for controlling a controlled variable of a controlled object by a control input, comprising:

controlled variable-detecting means for detecting the controlled variable;

target controlled variable-setting means for setting a target controlled variable serving as a target to which the controlled variable is controlled;

feedback correction value-calculating means for calculating a feedback correction value for performing feedback control of the controlled variable such that the controlled variable is caused to converge to the target controlled variable, with a predetermined feedback control algorithm;

first operational state parameter-detecting means for detecting a first operational state parameter indicative of an operational state of the controlled object, except for the controlled variable;

feedforward input-calculating means for calculating a feedforward input for feedforward-controlling the controlled variable to the target controlled variable, using a correlation model representative of a correlation between the feedforward input and the first operational state parameter, and the first operational state parameter; and control input-calculating means for calculating the control input based on a value obtained by correcting the feedforward input using the feedback correction value, wherein said feedforward input-calculating means calculates a modification value for making the feedback correction value equal to a predetermined target value with a predetermined control algorithm, modifies one of the first operational state parameter and the correlation model using the modification value, and calculates the feedforward input using the modified one of the first operational state parameter and the correlation model and the other thereof.

2. A control apparatus as claimed in claim 1, wherein said feedforward input-calculating means comprises:

modified operational state parameter-calculating means for calculating a modified operational state parameter by modifying the first operational state parameter using the modification value; and input-calculating means for calculating the feedforward input using the modified operational state parameter and the correlation model.

3. A control apparatus as claimed in claim 2, wherein said feedforward input-calculating means further comprises:

first sensitivity parameter-calculating means for calculating a first sensitivity parameter indicative of a sensitivity of the feedforward input to the first operational state parameter according to the first operational state parameter;

first modified difference-calculating means for calculating a first modified difference by modifying a difference between the feedback correction value and the predetermined target value using the first sensitivity parameter; and first modification value-calculating means for calculating the modification value with the predetermined control algorithm such that the first modified difference becomes equal to 0.

4. A control apparatus as claimed in claim 2, further comprising second operational state parameter-detecting means for detecting a second operational state parameter indicative of an operational state of the controlled object, except for the controlled variable, wherein said feedforward input-calculating means comprises second modification value-calculating means for calculating a plurality of first products by multiplying a difference between the feedback correction value and the predetermined target value by values of a plurality of respective predetermined first functions, calculating a plurality of first modification coefficients with the predetermined control algorithm such that the plurality of first products become equal to 0, calculating a plurality of second products by multiplying the plurality of first modification coefficients by the values of the plurality of respective predetermined first functions, respectively, and calculating the modification value using a total sum of the plurality of second products, and wherein the plurality of predetermined first functions are associated with a plurality of regions formed by dividing a region within which the second operational state parameter is variable, respectively, and are set to values other than 0 in the associated regions and to 0 in regions other than the associated regions, each two adjacent regions overlapping each other, the plurality of predetermined first functions being set such that an absolute value of a total sum of respective values of ones of the first functions associated with the overlapping regions becomes equal to an absolute value of a maximum value of the first functions.

5. A control apparatus as claimed in claim 4, wherein said second modification value-calculating means comprises:

second sensitivity parameter-calculating means for calculating a second sensitivity parameter indicative of a sensitivity of the feedforward input to the first operational state parameter according to the first operational state parameter;

first modified product-calculating means for calculating a plurality of first modified products by modifying the plurality of first products using the second sensitivity parameter; and first modification coefficient-calculating means for calculating a plurality of first modification coefficients with the predetermined control algorithm such that the plurality of first modified products become equal to 0.

6. A control apparatus as claimed in claim 1, wherein said feedforward input-calculating means comprises:

model value-calculating means for calculating a model value of the feedforward input using the first operational state parameter and the correlation model;

and input-setting means for setting a product of the model value and the modification value as the feedforward input.

7. A control apparatus as claimed in claim 6, further comprising third operational state parameter-detecting means for detecting a third operational state parameter indicative of an operational state of the controlled object, except for the controlled variable, wherein said feedforward input-calculating means comprises third modification value-calculating means for calculating a plurality of third products by multiplying a difference between the feedback correction value and the predetermined target value by values of a plurality of respective predetermined second functions, calculating a plurality of second modification coefficients with the predetermined control algorithm such that the plurality of third products become equal to 0, calculating a plurality of fourth products by multiplying the plurality of second modification coefficients by the values of the plurality of respective predetermined second functions, respectively, and calculating the modification value using a sum of a total sum of the plurality of fourth products and a predetermined value, and wherein the plurality of predetermined second functions are associated with a plurality of regions formed by dividing a region within which the third operational state parameter is variable, respectively, and are set to values other than 0 in the associated regions and to 0 in regions other than the associated regions, each two adjacent regions overlapping each other, the plurality of predetermined second functions being set such that an absolute value of a total sum of respective values of ones of the second functions associated with the overlapping regions becomes equal to an absolute value of a maximum value of the second functions.

8. A control apparatus as claimed in claim 7, wherein the first operational state parameter is formed by a plurality of operational state parameters indicative of operational states of the controlled object, and wherein said third modification value-calculating means sets the sum of the total sum of the plurality of fourth products and a predetermined value to the modification value.

9. A control apparatus as claimed in claim 7, wherein said third modification value-calculating means comprises:

third sensitivity parameter-calculating means for calculating a third sensitivity parameter indicative of a sensitivity of the feedforward input to the first operational state parameter according to the first operational state parameter;

third modified product-calculating means for calculating a plurality of third modified products by modifying the respective plurality of third products using the third sensitivity parameter; and second modification coefficient-calculating means for calculating the plurality of second modification coefficients with the predetermined control algorithm such that the plurality of third modified products become equal to 0.

10. A control apparatus as claimed in claim 1, wherein the controlled variable is an output from an exhaust gas concentration sensor for detecting a concentration of a predetermined component of exhaust gases in an exhaust passage of an internal combustion engine at a location downstream of a catalytic device, wherein the target controlled variable is a target output at which an exhaust emission reduction rate of the catalytic device is estimated to be placed in a predetermined state, wherein the controlled variable is an amount of fuel to be supplied to the engine, wherein the first operational state parameter is an operating condition parameter indicative of an operating condition of the engine, wherein the feedforward input is a basic value of the amount of fuel to be supplied to the engine, and wherein the feedback correction value is a fuel correction coefficient which is calculated with the predetermined feedback control algorithm such that the output from the exhaust gas concentration sensor converges to the target output, and by which the basic value of the amount of fuel to be supplied to the engine is multiplied.

11. A control unit including a control program for causing a computer to execute a method of controlling a controlled variable of a controlled object by a control input, wherein the method comprises:

a controlled variable-detecting step of detecting the controlled variable;

a target controlled variable-setting step of setting a target controlled variable serving as a target to which the controlled variable is controlled;

a feedback correction value-calculating step of calculating a feedback correction value for performing feedback control of the controlled variable such that the controlled variable is caused to converge to the target controlled variable, with a predetermined feedback control algorithm;

a first operational state parameter-detecting step of detecting a first operational state parameter indicative of an operational state of the controlled object, except for the controlled variable;

a feedforward input-calculating step of calculating a feedforward input for feedforward-controlling the controlled variable to the target controlled variable, using a correlation model representative of a correlation between the feedforward input and the first operational state parameter, and the first operational state parameter; and a control input-calculating step of calculating the control input based on a value obtained by correcting the feedforward input using the feedback correction value, wherein said feedforward input-calculating step includes calculating a modification value for making the feedback correction value equal to a predetermined target value with a predetermined control algorithm, modifying one of the first operational state parameter and the correlation model using the modification value, and calculating the feedforward input using the modified one of the first operational state parameter and the correlation model and the other thereof.

12. A control unit as claimed in claim 11, wherein said feedforward input-calculating step comprises:

a modified operational state parameter-calculating step of calculating a modified operational state parameter by modifying the first operational state parameter using the modification value; and a input-calculating step of calculating the feedforward input using the modified operational state parameter and the correlation model.

13. A control unit as claimed in claim 12, wherein said feedforward input-calculating step further comprises:

a first sensitivity parameter-calculating step of calculating a first sensitivity parameter indicative of a sensitivity of the feedforward input to the first operational state parameter according to the first operational state parameter;

a first modified difference-calculating step of calculating a first modified difference by modifying a difference between the feedback correction value and the predetermined target value using the first sensitivity parameter; and a first modification value-calculating step of calculating the modification value with the predetermined control algorithm such that the first modified difference becomes equal to 0.

14. A control unit as claimed in claim 12, further comprising a second operational state parameter-detecting step of detecting a second operational state parameter indicative of an operational state of the controlled object, except for the controlled variable, wherein said feedforward input-calculating step comprises a second modification value-calculating step of calculating a plurality of first products by multiplying a difference between the feedback correction value and the predetermined target value by values of a plurality of respective predetermined first functions, calculating a plurality of first modification coefficients with the predetermined control algorithm such that the plurality of first products become equal to 0, calculating a plurality of second products by multiplying the plurality of first modification coefficients by the values of the plurality of respective predetermined first functions, respectively, and calculating the modification value using a total sum of the plurality of second products, and wherein the plurality of predetermined first functions are associated with a plurality of regions formed by dividing a region within which the second operational state parameter is variable, respectively, and are set to values other than 0 in the associated regions and to 0 in regions other than the associated regions, each two adjacent regions overlapping each other, the plurality of predetermined first functions being set such that an absolute value of a total sum of respective values of ones of the first functions associated with the overlapping regions becomes equal to an absolute value of a maximum value of the first functions.

15. A control unit as claimed in claim 14, wherein said second modification value-calculating step comprises:

a second sensitivity parameter-calculating step of calculating a second sensitivity parameter indicative of a sensitivity of the feedforward input to the first operational state parameter according to the first operational state parameter;

a first modified product-calculating step of calculating a plurality of first modified products by modifying the plurality of first products using the second sensitivity parameter; and a first modification coefficient-calculating step of calculating a plurality of first modification coefficients with the predetermined control algorithm such that the plurality of first modified products become equal to 0.

16. A control unit as claimed in claim 11, wherein said feedforward input-calculating step comprises:

a model value-calculating step of calculating a model value of the feedforward input using the first operational state parameter and the correlation model; and an input-setting step of setting a product of the model value and the modification value as the feedforward input.

17. A control unit as claimed in claim 16, further comprising a third operational state parameter-detecting step of detecting a third operational state parameter indicative of an operational state of the controlled object, except for the controlled variable, wherein said feedforward input-calculating step comprises a third modification value-calculating step of calculating a plurality of third products by multiplying a difference between the feedback correction value and the predetermined target value by values of a plurality of respective predetermined second functions, calculating a plurality of second modification coefficients with the predetermined control algorithm such that the plurality of third products become equal to 0, calculating a plurality of fourth products by multiplying the plurality of second modification coefficients by the values of the plurality of respective predetermined second functions, respectively, and calculating the modification value using a sum of a total sum of the plurality of fourth products and a predetermined value, and wherein the plurality of predetermined second functions are associated with a plurality of regions formed by dividing a region within which the third operational state parameter is variable, respectively, and are set to values other than 0 in the associated regions and to 0 in regions other than the associated regions, each two adjacent regions overlapping each other, the plurality of predetermined second functions being set such that an absolute value of a total sum of respective values of ones of the second functions associated with the overlapping regions becomes equal to an absolute value of a maximum value of the second functions.

18. A control unit as claimed in claim 17, wherein the first operational state parameter is formed by a plurality of operational state parameters indicative of operational states of the controlled object, and wherein said third modification value-calculating step includes setting the sum of the total sum of the plurality of fourth products and a predetermined value to the modification value.

19. A control unit as claimed in claim 17, wherein said third modification value-calculating step comprises:

a third sensitivity parameter-calculating step of calculating a third sensitivity parameter indicative of a sensitivity of the feedforward input to the first operational state parameter according to the first operational state parameter;

a third modified product-calculating step of calculating a plurality of third modified products by modifying the respective plurality of third products using the third sensitivity parameter; and a second modification coefficient-calculating step of calculating the plurality of second modification coefficients with the predetermined control algorithm such that the plurality of third modified products become equal to 0.

20. A control unit as claimed in claim 11, wherein the controlled variable is an output from an exhaust gas concentration sensor for detecting a concentration of a predetermined component of exhaust gases in an exhaust passage of an internal combustion engine at a location downstream of a catalytic device, wherein the target controlled variable is a target output at which an exhaust emission reduction rate of the catalytic device is estimated to be placed in a predetermined state, wherein the controlled variable is an amount of fuel to be supplied to the engine, wherein the first operational state parameter is an operating condition parameter indicative of an operating condition of the engine, wherein the feedforward input is a basic value of the amount of fuel to be supplied to the engine, and wherein the feedback correction value is a fuel correction coefficient which is calculated with the predetermined feedback control algorithm such that the output from the exhaust gas concentration sensor converges to the target output, and by which the basic value of the amount of fuel to be supplied to the engine is multiplied.

21. A method of controlling a controlled variable of a controlled object by a control input, comprising:

a controlled variable-detecting step of detecting the controlled variable;

a target controlled variable-setting step of setting a target controlled variable serving as a target to which the controlled variable is controlled;

a feedback correction value-calculating step of calculating a feedback correction value for performing feedback control of the controlled variable such that the controlled variable is caused to converge to the target controlled variable, with a predetermined feedback control algorithm;

a first operational state parameter-detecting step of detecting a first operational state parameter indicative of an operational state of the controlled object, except for the controlled variable;

a feedforward input-calculating step of calculating a feedforward input for feedforward-controlling the controlled variable to the target controlled variable, using a correlation model representative of a correlation between the feedforward input and the first operational state parameter, and the first operational state parameter; and a control input-calculating step of calculating the control input based on a value obtained by correcting the feedforward input using the feedback correction value, wherein said feedforward input-calculating step includes calculating a modification value for making the feedback correction value equal to a predetermined target value with a predetermined control algorithm, modifying one of the first operational state parameter and the correlation model using the modification value, and calculating the feedforward input using the modified one of the first operational state parameter and the correlation model and the other thereof.

22. A method as claimed in claim 21, wherein said feedforward input-calculating step comprises:

a modified operational state parameter-calculating step of calculating a modified operational state parameter by modifying the first operational state parameter using the modification value; and a input-calculating step of calculating the feedforward input using the modified operational state parameter and the correlation model.

23. A method as claimed in claim 22, wherein said feedforward input-calculating step further comprises:

a first sensitivity parameter-calculating step of calculating a first sensitivity parameter indicative of a sensitivity of the feedforward input to the first operational state parameter according to the first operational state parameter;

a first modified difference-calculating step of calculating a first modified difference by modifying a difference between the feedback correction value and the predetermined target value using the first sensitivity parameter; and a first modification value-calculating step of calculating the modification value with the predetermined control algorithm such that the first modified difference becomes equal to 0.

24. A method as claimed in claim 22, further comprising a second operational state parameter-detecting step of detecting a second operational state parameter indicative of an operational state of the controlled object, except for the controlled variable, wherein said feedforward input-calculating step comprises a second modification value-calculating step of calculating a plurality of first products by multiplying a difference between the feedback correction value and the predetermined target value by values of a plurality of respective predetermined first functions, calculating a plurality of first modification coefficients with the predetermined control algorithm such that the plurality of first products become equal to 0, calculating a plurality of second products by multiplying the plurality of first modification coefficients by the values of the plurality of respective predetermined first functions, respectively, and calculating the modification value using a total sum of the plurality of second products, and wherein the plurality of predetermined first functions are associated with a plurality of regions formed by dividing a region within which the second operational state parameter is variable, respectively, and are set to values other than 0 in the associated regions and to 0 in regions other than the associated regions, each two adjacent regions overlapping each other, the plurality of predetermined first functions being set such that an absolute value of a total sum of respective values of ones of the first functions associated with the overlapping regions becomes equal to an absolute value of a maximum value of the first functions.

25. A method as claimed in claim 24, wherein said second modification value-calculating step comprises:

a second sensitivity parameter-calculating step of calculating a second sensitivity parameter indicative of a sensitivity of the feedforward input to the first operational state parameter according to the first operational state parameter;

a first modified product-calculating step of calculating a plurality of first modified products by modifying the plurality of first products using the second sensitivity parameter; and a first modification coefficient-calculating step of calculating a plurality of first modification coefficients with the predetermined control algorithm such that the plurality of first modified products become equal to 0.

26. A method as claimed in claim 21, wherein said feedforward input-calculating step comprises:

a model value-calculating step of calculating a model value of the feedforward input using the first operational state parameter and the correlation model; and an input-setting step of setting a product of the model value and the modification value as the feedforward input.

27. A method as claimed in claim 26, further comprising a third operational state parameter-detecting step of detecting a third operational state parameter indicative of an operational state of the controlled object, except for the controlled variable, wherein said feedforward input-calculating step comprises a third modification value-calculating step of calculating a plurality of third products by multiplying a difference between the feedback correction value and the predetermined target value by values of a plurality of respective predetermined second functions, calculating a plurality of second modification coefficients with the predetermined control algorithm such that the plurality of third products become equal to 0, calculating a plurality of fourth products by multiplying the plurality of second modification coefficients by the values of the plurality of respective predetermined second functions, respectively, and calculating the modification value using a sum of a total sum of the plurality of fourth products and a predetermined value, and wherein the plurality of predetermined second functions are associated with a plurality of regions formed by dividing a region within which the third operational state parameter is variable, respectively, and are set to values other than 0 in the associated regions and to 0 in regions other than the associated regions, each two adjacent regions overlapping each other, the plurality of predetermined second functions being set such that an absolute value of a total sum of respective values of ones of the second functions associated with the overlapping regions becomes equal to an absolute value of a maximum value of the second functions.

28. A method as claimed in claim 27, wherein the first operational state parameter is formed by a plurality of operational state parameters indicative of operational states of the controlled object, and wherein said third modification value-calculating step includes setting the sum of the total sum of the plurality of fourth products and a predetermined value to the modification value.

29. A method as claimed in claim 27, wherein said third modification value-calculating step comprises:

a third sensitivity parameter-calculating step of calculating a third sensitivity parameter indicative of a sensitivity of the feedforward input to the first operational state parameter according to the first operational state parameter;

a third modified product-calculating step of calculating a plurality of third modified products by modifying the respective plurality of third products using the third sensitivity parameter; and a second modification coefficient-calculating step of calculating the plurality of second modification coefficients with the predetermined control algorithm such that the plurality of third modified products become equal to 0.

30. A method as claimed in claim 21, wherein the controlled variable is an output from an exhaust gas concentration sensor for detecting a concentration of a predetermined component of exhaust gases in an exhaust passage of an internal combustion engine at a location downstream of a catalytic device, wherein the target controlled variable is a target output at which an exhaust emission reduction rate of the catalytic device is estimated to be placed in a predetermined state, wherein the controlled variable is an amount of fuel to be supplied to the engine, wherein the first operational state parameter is an operating condition parameter indicative of an operating condition of the engine, wherein the feedforward input is a basic value of the amount of fuel to be supplied to the engine, and wherein the feedback correction value is a fuel correction coefficient which is calculated with the predetermined feedback control algorithm such that the output from the exhaust gas concentration sensor converges to the target output, and by which the basic value of the amount of fuel to be supplied to the engine is multiplied.

* * * * *